US008061834B2

(12) United States Patent
Watanabe

(10) Patent No.: US 8,061,834 B2
(45) Date of Patent: Nov. 22, 2011

(54) PRINTING APPARATUS INCLUDING CASING

(75) Inventor: Hidetoshi Watanabe, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1238 days.

(21) Appl. No.: 11/685,712

(22) Filed: Mar. 13, 2007

(65) Prior Publication Data

US 2007/0216745 A1 Sep. 20, 2007

(30) Foreign Application Priority Data

Mar. 14, 2006 (JP) ..... 2006-069087
Mar. 14, 2006 (JP) ..... 2006-069088
Mar. 14, 2006 (JP) ..... 2006-069089

(51) Int. Cl.
*B41J 2/01* (2006.01)

(52) U.S. Cl. ..... 347/104

(58) Field of Classification Search ..... 271/34, 271/3.01, 9.01, 127; 454/184; 399/118, 399/390; 347/217, 104
See application file for complete search history.

(56) References Cited

U.S. PATENT DOCUMENTS 4,504,053 A * 3/1985 Shiozawa ..... 271/34
4,751,872 A * 6/1988 Lawson, Jr. ..... 454/184
4,788,571 A * 11/1988 Ura et al. ..... 271/3.01
5,203,552 A * 4/1993 Hoshi et al. ..... 271/9.01
5,281,997 A * 1/1994 Araki et al. ..... 399/118
5,632,477 A * 5/1997 Morinaga ..... 271/127
6,587,135 B1 * 7/2003 Suzuki et al. ..... 347/217
2005/0128276 A1 * 6/2005 Yamada ..... 347/104
2005/0201790 A1 * 9/2005 Inoue ..... 399/390
2007/0216745 A1 9/2007 Watanabe

FOREIGN PATENT DOCUMENTS

JP S55-123826 A 9/1980
JP S59-001285 A 1/1984
JP S60-180244 U 11/1985
JP 1286879 * 11/1989
JP H03-147648 A 6/1991
JP H06-156788 A 6/1994

(Continued)

OTHER PUBLICATIONS

Japan Patent Office; Notification of Reason for Refusal in Japanese Patent Application No. 2006-069087 (counterpart to the above-captioned U.S. patent application) mailed Sep. 24, 2009.

(Continued)

*Primary Examiner* — Stephen Meier
*Assistant Examiner* — Carlos A Martinez
(74) *Attorney, Agent, or Firm* — Baker Botts L.L.P.

(57) ABSTRACT

A printing apparatus includes a medium casing which accommodates at least one printing medium in a stack manner, an accommodated medium conveying unit which conveys the at least one printing medium accommodated in the medium casing from a first medium standby position to a second medium standby position, a feeding unit which feeds an outermost printing medium of the at least one printing medium conveyed to the second medium standby position from the medium casing, a printing medium conveying unit which conveys the fed printing medium from the feeding unit to a printing position, a print head which is disposed at a position opposed to the printing position and carries out a printing process on a printing surface of the conveyed printing medium, and a brush which brushes off the printing surface of the printing medium at a position between the second medium standby position and the printing position.

40 Claims, 12 Drawing Sheets

FOREIGN PATENT DOCUMENTS

| | | | | |
|---|---|---|---|---|
| JP | 9295721 | | * | 11/1997 |
| JP | H09-295721 | A | | 11/1997 |
| JP | 2002274668 | | * | 9/2002 |
| JP | 2003-220695 | A | | 8/2003 |
| JP | 2005-082294 | A | | 3/2005 |
| JP | 2005082294 | | * | 3/2005 |
| JP | 2005-169990 | A | | 6/2005 |
| JP | 2005179043 | A | | 7/2005 |
| JP | 2006-069739 | A | | 3/2006 |
| JP | 2006-182458 | A | | 7/2006 |
| JP | 2007-246191 | A | | 9/2007 |

OTHER PUBLICATIONS

Japanese Patent Office, Notification of Reason for Refusal for Japanese Patent Application No. 2006-069089, dated Sep. 16, 2008.

* cited by examiner

PRINTING APPARATUS INCLUDING CASING

CROSS-REFERENCE TO RELATED APPLICATION

This application claims priority from Japanese Patent Applications No. 2006-069087 filed on Mar. 14, 2006, No. 2006-069088 filed on Mar. 14, 2006 and No. 2006-069089 filed on Mar. 14, 2006, the entire subject matter of which is incorporated herein by reference.

TECHNICAL FIELD

Aspects of the present invention relate to a printing apparatus, and in particular to a printing apparatus having a medium casing for accommodating printing media.

BACKGROUND

JP-A-2005-179043 discloses a configuration of a sheet feeder that feeds media, which are accommodated in a casing, to the outside of the casing in a printing apparatus such as a printer, a copying machine, etc (see FIG. 1 and FIG. 3A through FIG. 5). The sheet feeder lifts printing media accommodated in a casing to a feeding position and feeds the most upwardly placed printing medium by a conveying roller.

However, printing media may be accommodated in a casing in a state where paper dust and dusty substances are adhered to the printing media or foreign substances are adhered thereto due to cutting of printing media. When the printing media fed from the casing with such foreign substances adhered thereto, and the printing media are subjected to printing by a printing apparatus such as a printer, the foreign substances are adhered to the print heads of the printer. Thus, printing quality may be deteriorated. For example, regarding an ink jet printer, nozzle holes are blocked up with foreign substances adhered to nozzles for discharging ink. Thus, ink discharging characteristics of the nozzles may be changed. Further, foreign substances may be adhered to the print heads of a thermal transfer printer. In this case, ink transfer may be defected or become uneven. Thus, there is a fear that foreign substances adhered to the printing media deteriorates the printing quality.

SUMMARY

Aspects of the invention provide a printing apparatus that ensures printing quality by preventing foreign substances adhered to printing media from being adhered to the print heads thereof. Further, aspects of the invention also provide a printing apparatus in which the printing quality is secured by preventing being printing media with foreign substances adhered thereto are conveyed to printing heads.

DETAILED DESCRIPTION

<General Overview>

According to an aspect of the invention, a printing apparatus comprises; a medium casing which accommodates at least one printing medium in a stack manner; an accommodated medium conveying unit which conveys the at least one printing medium accommodated in the medium casing from a first medium standby position to a second medium standby position; a feeding unit which feeds an outermost printing medium of the at least one printing medium conveyed to the second medium standby position from the medium casing; a printing medium conveying unit which conveys the fed printing medium from the feeding unit to a printing position; a print head which is disposed at a position opposed to the printing position and carries out a printing process on a printing surface of the conveyed printing medium; and a brush which brushes off the printing surface of the printing medium at a position between the second medium standby position and the printing position.

<Illustrative Embodiments>

Illustrative embodiments of the invention are described as follows with reference to the accompanying drawings.

Figure 1:
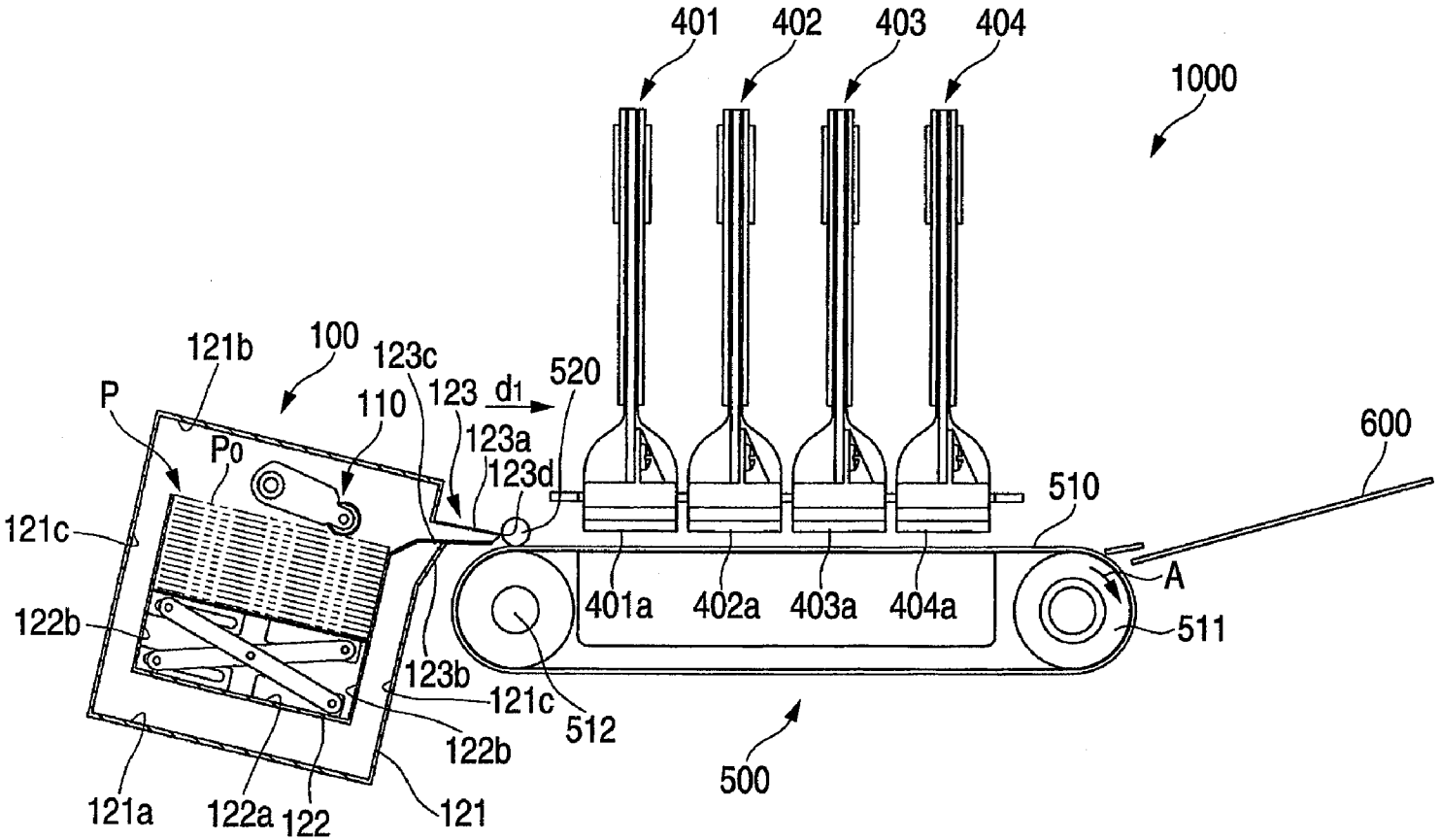
FIG. 1 is a schematic view showing a configuration of a printer.

The following description regards a preferred embodiment of the invention. FIG. 1 shows a brief configuration of an ink jet printer (printer) 1000.

[Printer]

The printer 1000 includes a sheet feeder 100, a sheet conveying unit 500, ink jet heads 401 through 404, and a sheet receiver 600. Also, in FIG. 1, the housing and a built-in computer of the printer 1000 are omitted. In addition, the interior of the sheet feeder 100 is illustrated.

The sheet feeder 100 includes a feeding unit 110, an outer casing 121, an inner casing 122 and a feeding portion 123, The inner casing 122 accommodates sheets P in a stacked state, and the outer casing 121 accommodates the entirety of the inner casing 122 so as to enclose the same. FIG. 1 shows the sections of these casings 121 and 122. The inner casing 122 presents a rough parallelepiped with its upper part open. The inner wall side of the inner casing 122 is composed of a bottom plane 122*a* (fourth inner wall) having a rectangular shape, and four inner side planes 122*b* erected from the four sides of the bottom plane 122*a* perpendicularly with respect to the bottom plane 122*a*. Respective sides of the sheets P accommodated in the inner casing 122 are matched to the four inner side planes 122*b* of the inner casing 122, respectively.

The outer casing 121 presents a rough parallelepiped similar to the shape of the inner casing 122. The inner wall side of the outer casing 121 is composed of a bottom plane 121*a* (either one of first inner wall or second inner wall) having a rectangular shape, a ceiling plane 121*b* opposed to the bottom plane 121*a*, and four inner side planes 121*c* (third inner wall) erected from the four sides of the bottom plane 121*a* perpendicularly with respect to the bottom plane 121*a*. The four inner side planes 121*c* link respective sides opposed to the bottom plane 121*a* and the ceiling plane 121*b* with each other, respectively. The inner casing 122 is accommodated in the interior of the outer casing 121 so that the bottom plane 121*a* of the outer casing 121 and the bottom plane 122*a* of the inner casing 122 become parallel to each other, and the inner side planes 121*c* of the outer casing 121 and the inner side planes 122*b* of the inner casing 122 become parallel to each other.

The feeding unit 110 is installed upward of the inner casing 122 in the interior of the outer casing 121, and feeds the most upwardly located sheet PO of sheets P, which are accommodated in the inner casing 122, to the outside of the outer casing 121. The feeding portion 123 is formed at the outer casing 121 and the inner casing 122. The feeding portion 123 has an opening to communicate the interior and the exterior of the outer casing 121 with each other, wherein the fed sheet P by the feeding unit 110 is fed to the exterior of the outer casing 121 through the feeding portion 123.

The sheet conveying unit 500 includes a conveying belt 510, belt rollers 512 and 512, and a conveying roller 520. The belt rollers 511 and 512 are located to be spaced from each other in the horizontal direction. The belt roller 511 is driven by a motor (not illustrated), and is caused to turn in the direction of the arrow A in FIG. 1. The bent roller 512 is a driven roller rotating in the same direction as that of the belt roller 511.

The conveying belt 510 is an endless belt installed around the periphery of the belt rollers 511 and 512. The conveying belt 510 runs in the direction of rotation of the belt roller 511 as the belt roller 511 begins to rotate. Therefore, the belt roller 511 runs clockwise when being faced toward the sheet of FIG. 1. Two horizontal areas connecting the belt roller 511 and the belt roller 512 to each other are formed in the conveying belt 510. The upper surface of the upward area of the two areas is a conveying surface of printing sheets.

The conveying roller 520 is installed near the most upstream position in the conveying direction d1 on the conveying surface of the conveying belt 510 and has a rotation axis perpendicular to the sheet of the drawing. The conveying roller 520 is pressed toward the belt roller 512 and the conveying belt 510 is held between the conveying roller 520 and the belt roller 512. As the conveying belt 510 rotates, the conveying roller 520 begins rotating by receiving torque based on the rotation in the inverse direction of the rotation direction of the conveying belt 510 by a friction force from the conveying belt 510.

The sheet feeder 100 is installed so that the bottom plane 122*a* of the inner casing 122 is slightly inclined from the horizontal position clockwise in the drawing. That is, the sheets P are inclined with respect to the conveying surface, and the sheets P are not parallel to the conveying surface. Also, where the sheets P are perpendicular to the conveying surface, the sheets P are not smoothly fed onto the conveying surface. Therefore, the sheet feeder 100 is installed so that the sheets P and the conveying surface are not parallel or at 90 degrees, and so that the sheets P accommodated in the inner casing 122 and the conveying belt 510 are positioned in any state from a parallel state to a state where the angle between the upper surface (Printing surface) of an uppermost located sheet Po of the sheets P accommodated in the inner casing 122 and the conveying surface becomes 90 degrees.

Furthermore, the sheet feeder 100 is installed so that the tip end of the sheet guide 123*c* protruding from the opening of the outer casing 121 is disposed in the vicinity of the position where the conveying roller 520 and the conveying belt 510 are brought into contact with each other. The fed sheet P from the feeding portion 123 by the feeding unit 110 is guided by the sheet guide 123 and reaches the position where the conveying roller 520 and the conveying belt 510 are brought into contact with each other. The sheet P is moved along the conveying direction d1 in line with movement of the conveying belt 510 while being held between the conveying roller 520 and the conveying belt 510.

The ink jet heads 401 through 404 have a nozzle (not illustrated) for discharging ink. The respective nozzles are formed on the bottom surfaces (nozzle surfaces) 401*a* through 404*a* of the respective ink jet heads 401 through 404. Inks of colors differing from each other are discharged from the nozzles of the ink jet heads 401 through 404. The ink jet heads 401 through 404 are juxtaposed along the conveying direction d1, and the respective nozzle surfaces 401*a* through 404*a* are opposed to the conveying surface upward of the conveying belt 510 with predetermined space remaining between the nozzle surfaces and the conveying surface.

The printer 1000 has a printing control section 310 described later. The printing control section 310 is controlled by instructions from a personal computer connected to the printer 1000, and transmits control signals corresponding to printing data to the ink jet heads 401 through 404, respectively. The ink jet heads 401 through 404 discharge inks from the nozzles in compliance with the control signals. On the other hand, a sheet P is conveyed to the position (printing position) opposed to the nozzle surfaces 401*a* through 404*a* by the conveying belt 510. Thus, inks discharged from the nozzles of the ink jet heads 401 through 404 land onto the sheet P, whereby a printing image corresponding to the printing data is formed on the surface (printing surface) of the sheet P.

The sheet receiver 600 is located adjacent to the conveying surface of the conveying belt 510 in the most downstream position in regard to the conveying direction d1. The sheet P on which a printing image has been formed by the ink jet heads 401 through 404 is conveyed to the sheet receiver 600 by the conveying belt 510. Thus, the sheet P on which printing has been completed is stacked onto the sheet receiver 600 one after another.

[Sheet Feeder]

Figure 2:
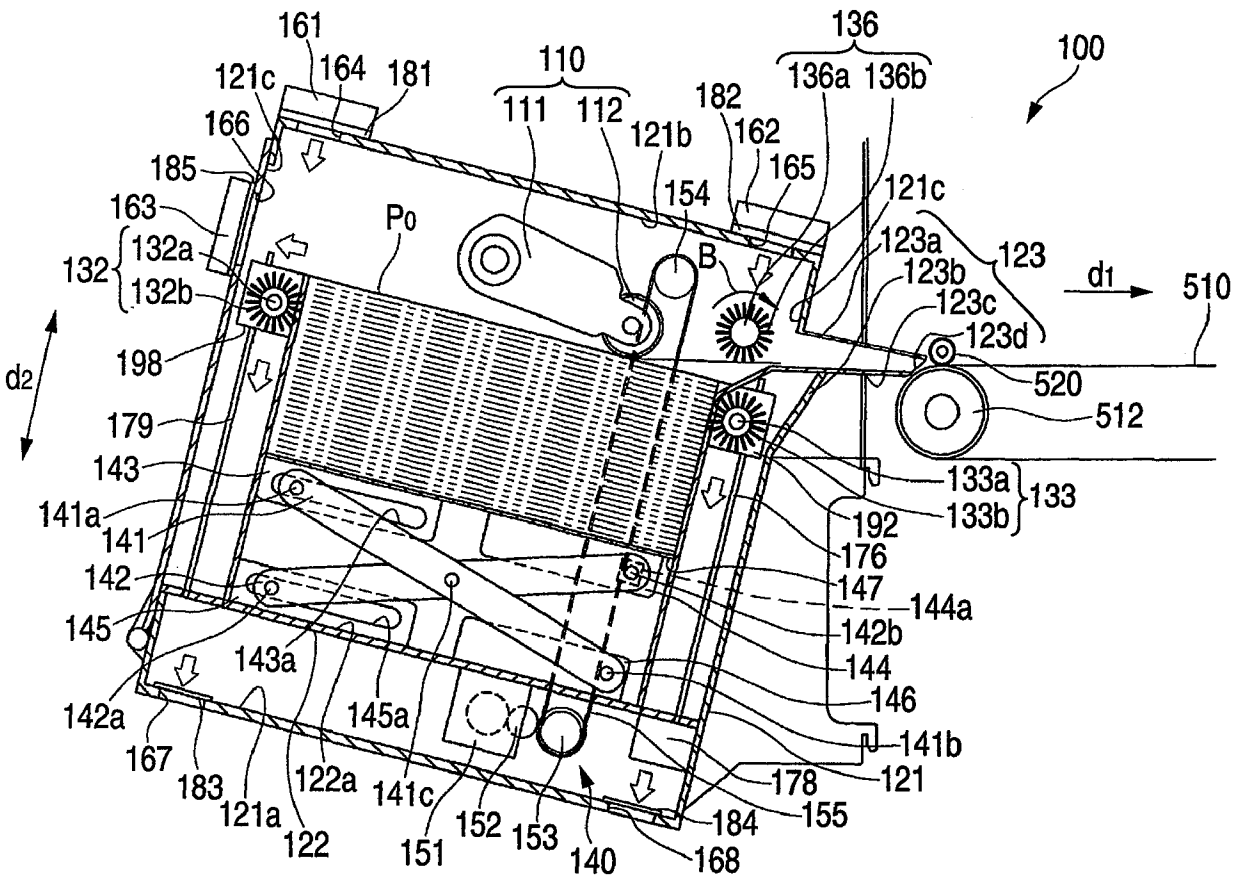
FIG. 2 is a view showing an internal configuration of a sheet feeder shown in FIG. 1.

FIG. 2 is an enlarged view of the vicinity of the sheet feeder 100 in FIG. 1. The sheet feeder 100 includes an accommodated sheet conveying unit (Accommodated medium conveying unit) 140 for a plurality of sheets P accommodated in the inner casing 122. The accommodated sheet conveying unit 140 includes a sheet base 146, arms 141 and 142, and supporting/guiding members 143, 144, 145 and 146. The sheet base 147 is a flat-shaped member on which sheets P are stacked and placed. In addition, the sheet base 147 is disposed parallel to the bottom plane 122*a* of the inner casing 122.

The supporting/guiding members 143, 144, 145 and 146 are flat-shaped members that are long in one direction. Guide slots 143*a* and 145*a* are formed in the supporting/guiding members 143 and 145 among them. Either of the guide slots 143*a* and 145*a* is formed near the middle of the supporting/guiding members 143 and 145 and is penetrated in the thickness direction of the supporting/guiding members 143 and 145. Also, the guide slots 143*a* and 145*a* become like a long slot extending in the lengthwise direction of the supporting/guiding members 143 and 145.

The supporting/guiding members 145 and 146 are fixed on the bottom plane 122*a*, and the supporting/guiding members 143 and 144 are fixed on the underside of the sheet base 147. These supporting/guiding members 143 through 146 are fixed so that, in the plan view parallel to the bottom plane 122*a*, the guide slot 143*a* and the guide slot 145*a* are stacked, and a pin 142*b* and a pin 141*b* each described later are stacked. Also, any one of the supporting/guiding members 143 through 146 extends along the same plane parallel to any one of the inner side planes 122*b* of the inner casing 122, and the lengthwise direction of any one of the supporting/guiding members 143 through 146 is made parallel to the bottom plane 122*a*.

The arms 141 and 142 are long and slender flat-shaped members. The arms 141 and 142 are stacked in the thickness direction and are connected to each other in the vicinity of the respective centers by a pin 141*c*. The arms 141 and 142 relatively turn, using the pin 141*c* as a rotation axis. As shown in FIG. 2, the arms 141 and 142 are rotatably connected to the supporting and guiding members 146 and 144 by pins 141*b* and 142*b* in the vicinity of one end of the arms 141 and 142, respectively, Further, the other ends of the arms 141 and 142 axe connected by pins 141*a* and 142 so that the ends thereof slide along the guide slots 143*a* and 145*a*.

The accommodated sheet conveying unit 140 further includes a drive motor 151, a gear 152, belt rollers 153 and 154, and a drive belt 155. The belt roller 153 is installed between the bottom plane 121*a* of the outer casing 121 and the inner casing 122 so that it turns around the rotation axis perpendicular to the drawing. The belt roller 154 is installed between the ceiling plane 121*b* of the outer casing 121 and the inner casing 122 so that it turns around the rotation axis perpendicular to the drawing. The belt roller 153 is driven by the drive motor 151 via the gear 152. The drive motor 151 causes the belt roller 153 to turn in either of the counterclockwise and clockwise directions in the drawing. The belt roller 154 is a driven roller turning in the rotation direction of the belt roller 153.

The drive belt 155 is installed around the belt rollers 153 and 154. A part of the surface of the drive belt 155 is fixed and held at a projection 144*a* formed integral with the supporting and guiding member 144. Therefore, as the belt roller 153 is driven, the drive belt 155 turns, and in line therewith, the supporting and guiding member 144 fixed at the drive belt 155 moves along the conveying direction d2 of sheets P. In addition, the conveying direction d2 is parallel to the direction along which the sheets accommodated in the inner casing 122 are stacked (that is, stacking direction)

Figure 3A:
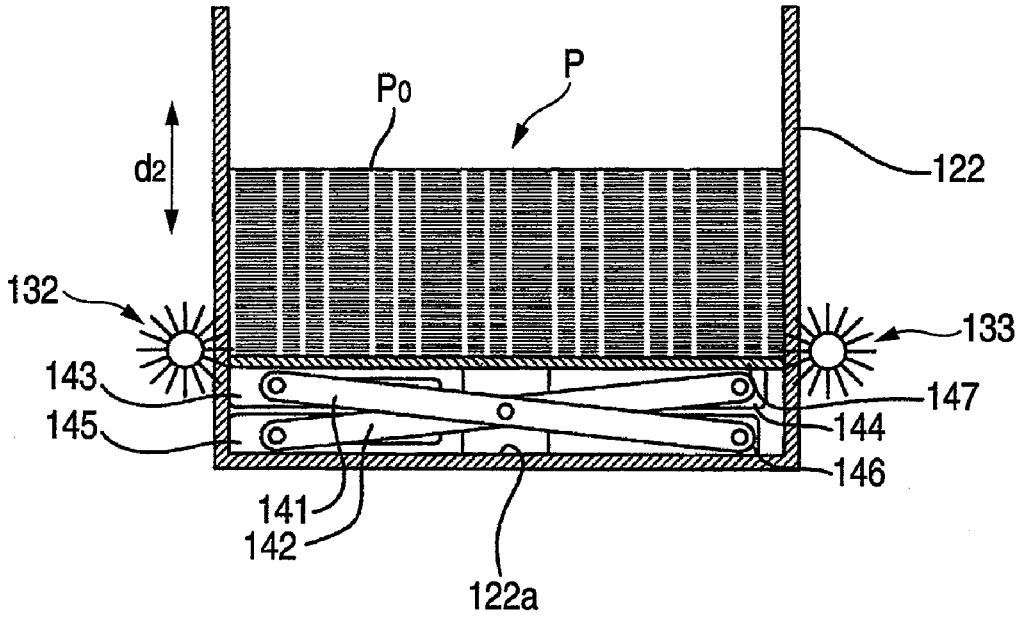
FIGS. 3A and 3B are diagrams showing movements of sheets and brushes accommodated in the sheet feeder shown in FIG. 2.
Figure 3B:
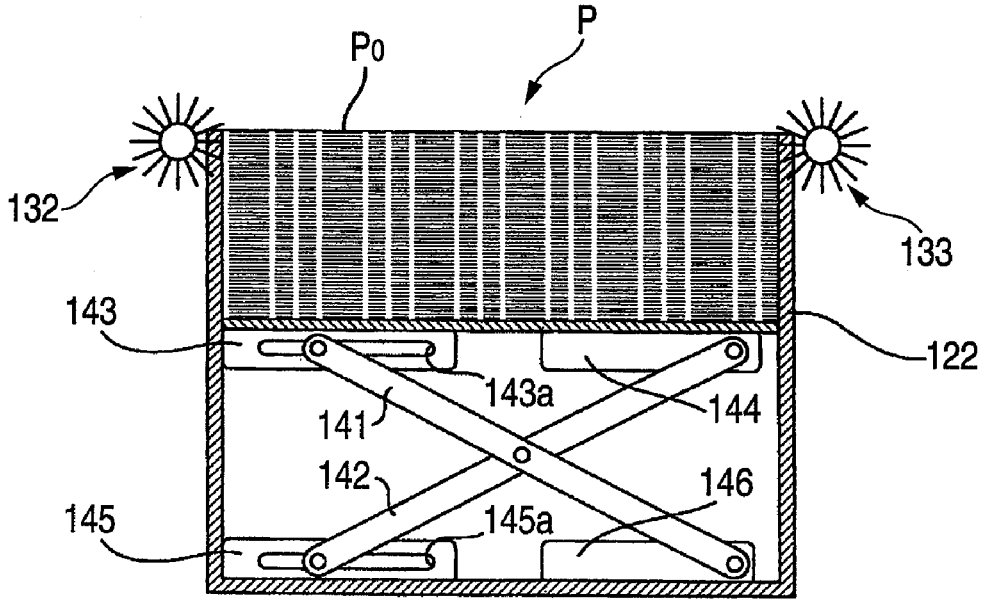

Since the accommodated sheet conveying unit 140 has the above-described configuration, sheets P accommodated in the inner casing 122 are conveyed along the conveying direction d2 shown in FIGS. 3A and 3B. FIG. 3A shows a case where the sheet base 147 is approached closest to the bottom plane 122*a* of the inner casing 122. The position of the sheets P at this time is a sheet standby position (that is, the first medium standby position) Also, FIG. 3B shows a case where the most upward stacked sheet Po of the sheets accommodated in the inner casing 122 reaches the opening of the inner casing 122. The position of the sheets P at this time is a sheet feeding position (that is, the second medium standby position)

As the drive belt 155 is driven by the drive motor 151, the sheet base 147 is elevated from the position corresponding to the sheet standby position in FIG. 3A by the supporting and guiding member 144. In line therewith, the ends of the arms 141 and 142 slide along the guide slots 143*a* and 145*a* of the supporting and guiding members 143 and 145. When the sheet P reaches the sheet feeding position shown in FIG. 3B, conveying of sheets P is stopped. Or, by the drive motor 152 causing the belt roller 153 to turn in the reverse direction, sheets P are conveyed from the state shown in FIG. 3B to the state shown in FIG. 3A.

As shown in FIG. 2, the feeding unit 110 is composed of an arm 111 and a feeding roller 112. The feeding roller 112 is supported by the arm 111 so that it can rotate around a rotation axis perpendicular to FIG. 2. The feeding roller 112 is driven by a motor (not illustrated), and turns counterclockwise in the drawing. The feeding unit 110 is disposed between the opening of the inner casing 122 and the ceiling plane 121*b* of the outer casing 121, The arm 111 is installed at the position where the feeding roller 112 is brought into contact with the most upward stacked sheet Po when the sheet is conveyed to the position shown in FIG. 3B by the accommodated sheet conveying unit 140. At this time, the feeding roller 112 is pressed onto the upper surface of the most outward sheet Po in the sheet stacking direction.

The feeding portion 123 is formed in the outer casing 121 and the inner casing 122. The feeding portion 123 is composed of projection portions 123*a* and 123*b* in which parts of a side plate of the outer casing 121 project outward, from a sheet guide 123*c*. An opening is formed between the projection portion 123*a* and another projection portion 123*b*, and the sheet guide 123*c* is installed in the opening. One end of the sheet guide 123*c* is connected to the opening of the inner casing 122 to become integral therewith. The sheet guide 123*c* is bent in two stages from one end thereof connected to the opening of the inner casing 121 to the opening formed between the projection portion 123*a* and the projection portion 123*b* and further extends horizontally outward of the outer casing 122 from there. An opening (feeding port) 123*d* through which sheets P are fed from the sheet feeder 100 is formed between the end part of the projection portion 123*a* and the end part of the sheet guide 123*c*.

A sheet Po conveyed to the vicinity of the opening of the inner casing 121 by the accommodated sheet conveying unit 140 is fed outward of the outer casing 122 along the sheet guide 123*c* in line with rotations of the feeding roller 112 when the feeding roller 112 is driven.

Figure 4:
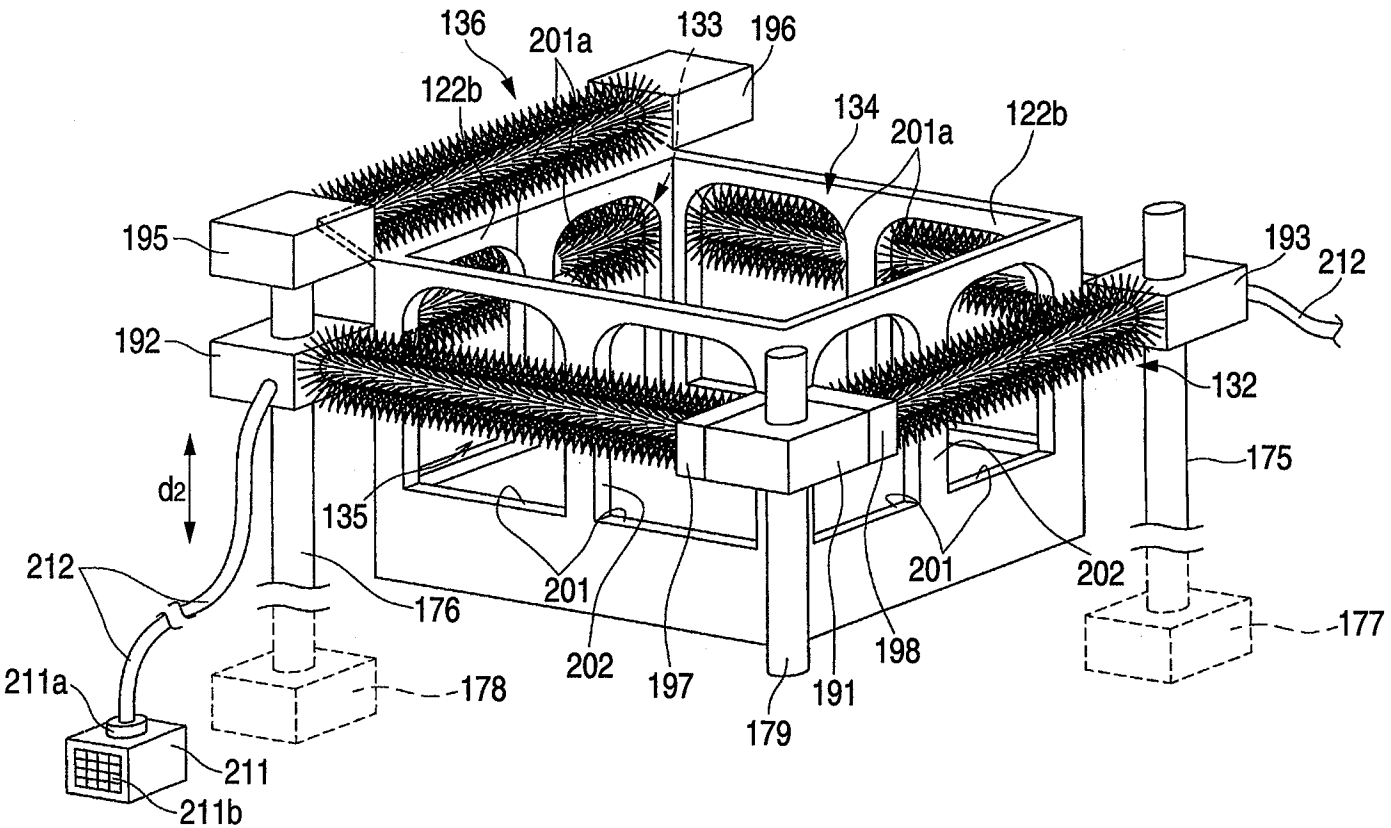
FIG. 4 is a perspective view showing the periphery of the inner casing of the sheet feeder shown in FIG. 2.

The sheet feeder 100 further includes various types of brushes 132 through 136 used for cleaning sheets P as shown in FIG. 4. The brushes 132 through 136 clean up sheets at various points of the conveying path of sheets that are conveyed from the sheet standby position of FIG. 3A to the sheet feeding position of FIG. 3B and are further fed outward of the sheet feeder 100. The brush 136 of these brushes 132 through 136 is installed adjacent to the feeding portion 123 at the most downstream position in the conveying path in the sheet feeder 100. In further detail, at the sheet feeding position, the brush 136 is installed between the tip end of the sheet Po at the feeding side and the above-described feeding portion 123, and brushes off foreign substances on the sheet Po (printing surface) fed toward the feeding portion 123.

The main body 136*a* of the brush 136 is cylindrically shaped as described later, and is installed so as to turn around the symmetrical axis of the main body 136*a* of the brush 136. The brush 136 is connected to a motor 196 as described later, and is turned so that the tip ends of the brush hairs 136*b* brush off the printing surface of sheets P in the reverse direction of the direction along which the sheets P are fed. That is, the brush 136 turns in the direction of the arrow B in FIG. 2 so that a force operates on the sheets P in the reverse direction of the direction along which the sheets P are fed from the feeding portion 123. Therefore, where the rotation speed of the brush 136 is the same, the relative speed when the tip ends of the brush hairs 136*b* are brought into contact with the printing surface of the sheets P becomes greater than in the case where the brush 136 turns in the same direction as the direction along which the sheets P are fed. Accordingly, it is possible to further securely brush off foreign substances adhered to the printing surfaces of the sheets P.

In addition, brushes 132, 133, 134 and 135 are installed at the periphery of sheets P accommodated in the inner casing 122. Also, FIG. 2 shows only two brushes 132 and 133 of them. The brushes 132 and 133 have main bodies 132*a* and 133*a* that are cylindrically shaped as described later. The main bodies 132*a* and 133*a* are installed so as to turn around the symmetrical axes of the brush main bodies. In addition, bearings and a motor are provided at both ends of the brushes as described later. The brushes are rotated by respective motors. Only a motor 198 and a bearing 192 are shown in FIG. 2. Foreign substances are brushed off from the periphery of the sheets P accommodated in the inner casing 122 by the brushes 132 through 135.

On the other hand, ball screws 175 and 176 and two slider supporting shafts including a slider supporting shaft 179 are installed between the inner side plane 121*c* of the outer casing 121 and the inner casing 122. Also, in FIG. 2, only the ball screw 176 and the slider supporting shaft 179 of these appear. The ball screws 175, 176 and two slider supporting shafts 179 extend along the inner side plane 121*c*. As described later, the ball screws 175, 176 and two slider supporting shafts 179 are disposed so as to hold the inner casing 122 therebetween on the extension of the diagonal lines of the sheets P accommodated in the inner casing 122. That is, the ball screws 175, 176 and two slider supporting shafts 179 are installed between the corners formed by two adjacent inner side planes 121*c* and the corners of the inner casing 122. Further, screw-turning motors 177 and 178 are installed below the ball screws 175 and 176, respectively. The screw-turning motors 177 and 178 are fixed in the lower part of the inner side plane 121*c* but at the position not opposed to the side plate of the inner casing 122. Further, only the screw-turning motor 178 of the two screw-turning motors appears in FIG. 2.

Ends of the ball screws 175 and 176 are, respectively, connected to the drive shafts of the rotation motors 177 and 178, and the ball screws 175 and 176 are rotated by the screw-turning motors 177 and 178. The screw-turning motors 177 and 178 are able to turn the ball screws 175 and 176 in either direction with respect to the rotation axes thereof. Also, bearings of the brushes 132 and 133 are provided with threading (not illustrated) engaged with the ball screws 175 and 176, by which the bearings move along the ball screws in line with rotations of the ball screws. The screws of the bearings are engaged with the screws of the ball screws 175 and 176. Therefore, the brushes 132 and 133 vertically move along with the bearings by drive of the screw-turning motors 177 and 178. In addition, the brushes 134 and 135 vertically move in interlock with movement of the brushes 132 and 133 as described later.

With the above-described construction, the brushes 132 through 135 can move from the brush standby position (the first brush standby position) corresponding to the sheet standby position of FIG. 3A to the brush cleaning position (the second brush standby position) corresponding to the sheet feeding position of FIG. 3B along the conveying direction d2.

The sheet feeder 100 further includes intake fan units 161 and 162 and an exhaust fan unit 163. Also, through-holes 164 and 165 are formed in the ceiling plate of the outer casing 121, and a through-hole 166 is formed in the side plate thereof. The intake fan units 161 and 162 are attached to the through-holes 164 and 165 of the ceiling plate, and the exhaust fan unit 163 is attached to the through-hole 166 of the side plate, so that the openings thereof are enclosed. In addition, the through-holes 164 and 165 are formed in the vicinity of the two inner side planes 121*c* opposed to each other in the conveying direction. Of these, the through-hole 165 is close to the feeding portion 123. Further, the through-hole 166 is located at the opposite side of the feeding portion 123, and is formed at the position opposed to the opening 123*d* (the feeding portion 123) of the inner side plane 121*c*. The position can overlook the feeding portion 123 (the opening 123*d*) along the upper surface of the sheets P located at the sheet feeding position. The intake fan units 161 and 162 are driven to rotate internal fans, wherein air flows headed from the outside of the outer casing 121 to the inside thereof are generated. Therefore, the interior of the outer casing 121 is made into positive pressure. In other words, pressure is applied to air in the vicinity of the openings at the exterior of the through-holes 164 and 165 by rotations of the fans, so that the air is oriented inwardly of the through-holes 164 and 165. Further, as the exhaust fan unit 163 is driven, air flows along the upper surface of the sheet P are guided to the outside of the outer casing 121.

Filters 181 and 182 are installed between the intake fan units 161, 162 and the through-holes 164, 165. The filters 181 and 182 filtrate air from the intake fan units 161 and 162 and remove foreign substances therefrom. Therefore, foreign substances hardly enter the interior of the outer casing 121.

Through-holes 167 and 168 are further formed in the bottom plate of the outer casing 121. The through-hole 168 of these is formed in the vicinity of the inner side plane 121*c* in which the opening 123*d* is formed. Filters 183 and 184 are adhered to the openings of the through-holes 167 and 168 in the bottom plane 121*a* of the outer casing 121 so that the openings are covered therewith. In addition, a filter 185 is installed between the exhaust fan unit 163 and the through-hole 166. The filters 183 through 185 are filters to filtrate air as the filter 181, etc. The filters 183 through 185 are installed so that foreign substances are not brought in mainly from the exterior of the outer casing 121 through the through-holes 166 through 168. The meshes thereof are rougher than those of the filter 181, etc., based on the reason that ventilation to the exterior of the casing is not hindered.

Air flows as shown by the outlined arrows in FIG. 2 are generated in the interior of the outer casing 121 by the through-holes 164 through 168 and the fan units 161 through 163 as described above. That is, outside air of the outer casing 121 is brought into the interior thereof, by the intake fan units 161 and 162 through the through-holes 164 and 165. From there, the air is oriented downward along the inner casing 122 between the inner side plane 121*c* of the outer casing 121 and the inner casing 122, and is caused to flow out to the outside through the through-holes 167 and 168. Therefore, foreign substances brushed off from the sheets P by the brushes 132 through 135 and foreign substances adhered to the peripheries of the sheets P are conveyed by downward air flows, and are exhausted to the exterior of the outer casing 121 through the through-holes 167 and 168.

Air brought in through the through-hole 165 is oriented toward the brush 136 disposed so as to be opposed to the through-hole 165. Air reached to the installation position of the brush 136 is turned into an air flow flowing between the ceiling plane 121*b* of the outer casing 121 and the sheets P located at the sheet feeding position, and is caused to flow out through the through-hole 166. Therefore, foreign substances brushed off from the sheets P by the brush 136 are conveyed by the air flow along the ceiling plane 121*b*, and are discharged to the exterior of the outer casing 121 through the through-hole 166.

Thus, since foreign substances brushed off from the sheets by the respective brushes 132 through 136 are discharged to the exterior of the outer casing 121 by air flows, the foreign substances can be prevented from being adhered to the sheets again. Also, since air flows are formed between the outer casing 121 and the inner casing 122, air flows formed along the side plates of the inner casing 122 and the upper part thereof can be securely held, in comparison with the case where the outer casing 121 is not provided. Thus, it becomes possible to prevent sheets from being conveyed to the ink jet heads with foreign substances adhered thereto.

Also, the through-holes 164 and 165 that become inflow ports of air are formed in the vicinity of the upper ends of the side plates of the outer casing 121 in the ceiling plate of the outer casing 121. Further, the through-holes 167 and 168 that become outflow ports are formed in the vicinity of the lower ends of the side plates of the outer casing 121 in the bottom plate of the outer casing 121. For this reason, air flows easily occur along the side plates of the outer casing 121 and the inner casing 122, wherein foreign substances brushed off by the brush 132, etc., can be further securely discharged by the air flows. Still further, the through-hole 165 is formed near the brush 136 while the through-hole 166 is formed farthest from the brush 136 of the inner side plane 121*c*. Accordingly, air flows, which pass through the upper surface of the sheet Po through the vicinity of the brush 136 and flows out from the through-hole 166, easily occur, wherein foreign substances brushed off by the brush 136 and foreign substances adhered to the upper surface of the sheet Po can be easily discharged by the air flows.

[Brush]

FIG. 4 is a perspective view showing the periphery of the inner casing 122. The brushes 132 through 135 provided so as to enclose the periphery of the inner casing 122 are installed so as to respectively correspond to four inner side planes 122*b* that compose the inner wall planes of the inner casing 122. That is, brushes are installed one by one at positions opposed to four side plates where the inner side plane 122*b* is formed.

The sheet feeder 100 is provided with brush-turning motors 197 and 198 that rotate the brushes, and two more brush-turning motors (not illustrated in FIG. 4) are installed. In addition, bearings 192 and 193 that support the main bodies 132*a* through 135*a* (Refer to FIG. 5) of the brushes 132 through 135 are installed. Further, a slider 191 and a slider supporting shaft 179, which support the brush-turning motors 197 and 198, are installed, and at the same time, another separate slider and another slider-supporting shaft, which support two brush-turning motors (not illustrated in FIG. 4) and are not illustrated in FIG. 4, are provided.

The bearings 192 and 193 are disposed so as to hold the inner casing 122 therebetween on the extension line of one hexagonal line of the bottom plane 122*a* in its plan view parallel to the bottom plate 122*a* of the inner casing 122. Also, the slider 191 is disposed on the extension line of the other diagonal line, and the other slider is disposed so as to hold the inner casing 122 between the same and the slider 191 on the extension line of the other diagonal line (Refer to FIG. 5). These two bearings, two sliders and four brush-turning motors are disposed at the same positions in regard to the conveying direction d2.

The slider 191 is provided with two opposing faces opposed to the bearing 192 and 193, respectively, and the brush-turning motors 197 and 198 are fixed on these two opposing faces, respectively. The slider not illustrated in FIG. 4 is provided with two opposing faces opposed to the bearings 192 and 193, respectively, and two brush-turning motors are fixed on these two opposing faces, respectively.

As shown in FIG. 4, both ends of the brush 132 are supported by the bearing 193 and the brush-turning motor 198, respectively, and both ends of the brush 135 are supported by the bearing 192 and the brush-turning motor 197, respectively. Therefore, the brushes 132 and 135 are disposed at the positions opposed to two side planes 122*b* of the inner casing 122, which are adjacent to each other, respectively. On the other hand, ends of the brushes 133 and 134 are supported at the bearings 192 and 193, respectively, and at the same time, the other ends of the brushes 133 and 134 are supported by two 26 brush-turning motors not illustrated in FIG. 4. Accordingly, the brushes 133 and 134 are disposed at the positions opposed to separate two side planes 122*b* adjacent to each other.

The drive shafts of the brush-turning motors 197 and 198 are, respectively, fixed at ends of the brushes 135 and 132. The bearings 192 and 193, respectively, support the brushes 135 and 132 so that they can freely rotate. These brushes rotate around the symmetrical axes of the brushes 135 and 132 by the brush-turning motors 197 and 198. On the other hand, the drive shafts of the two brush-turning motors not appearing in FIG. 4 are, respectively, fixed at the ends of the brushes 133 and 134. The bearings 192 and 193, respectively, support the brushes 133 and 134 so that they can freely rotate. These brushes rotate around the symmetrical axes of the brushes 133 and 134 by the two brush-turning motors not appearing in FIG. 4.

The ball screws 176 and 175 penetrate the bearings 192 and 193 in the vertical direction. As described above, a female screw is threaded in the interior of the bearings 192 and 193. Male screws of the ball screws 175 and 176 are, respectively, engaged with the female screws of the bearings 192 and 193 in the interior of the bearings 192 and 193. Screw-turning motors 177 and 178 are installed downward of the ball screws 175 and 176. The lower ends of the ball screws 175 and 176 are, respectively, fixed at the drive shafts of the screw-turning motors 177 and 178. In addition, the slider support shaft 179 is installed in the sheet feeder 100. The slider support shaft 179 is a rod-like member, and both ends thereof are fixed on the outer casing 121. The slider support shaft 179 passes through the slider 191 in the vertical direction, and supports the slider 191 so that the slider can move parallel to the conveying direction d2 (vertical direction) along the slider support shaft 179. Another slider support shaft is disposed at the side opposite to the slider support shaft 179 with the inner case 122 held therebetween. The slider support shaft supports the slider not appearing in FIG. 4 so that the slider shaft can move along the conveying direction d2.

According to the above-described construction, the brushes 132 through 135 move along the conveying direction d2 while these brushes mutually maintain the same position with respect to the conveying direction d2. At this time, the four brush-turning motors move together. Therefore, the brushes 132 through 135 can move along the conveying direction d2 while rotating by the four brush-turning motors. Further, air brought in from the outside is turned into air flows flowing in the gap between the inner casing 122 and the outer casing 121 and is caused to flow out through the respective through-holes 167 and 168 based on the positional relationship between the intake fan units 161, 162 and the through-holes 167,168 in the bottom plane of the outer casing 121. Accordingly, the brushes 132 and 133 and brushes 134 and 135, which are disposed so as to be opposed to each other, are turned in the directions opposed to each other. For example, the brushes 132 and 133 shown in FIG. 2 rotate so that the brush 132 turns clockwise and the brush 133 turns counter-clockwise. Thereby, dusty substances and foreign substances brushed off by the brushes 132 and 133 are easily discharged to the exterior by virtue of the air flows oriented to the respective through-holes 167 and 168.

Furthermore, the sheet feeder 100 includes a brush-turning motor 196 for rotating the brush 136 and a bearing 195 of the brush 136. The bearing 195 is disposed upward of the bearing 192 and is fixed on the outer casing 121. The bearing 195 rotatably supports one end of the brush 136, and simultaneously, supports the upper end of the ball screw 176 so that the ball screw 176 can freely turn.

The brush-turning motor 196 is disposed upward of the brush-turning motor that causes the brushes 133 and 134 to rotate and does not appear in FIG. 4, and is fixed on the outer casing 121. The other end of the brush 136 is connected to the drive shaft of the brush-turning motor 196. With such a construction, the brush 136 is made rotatable in the direction B shown in FIG. 2 by drive of the brush-turning motor 196.

[Opening of Inner Casing]

A penetration area 201 is formed on four side plates of the inner casing 122, respectively. The penetration area 201 penetrates from the outer side face of the side plate of the inner casing 122 to the inner side face thereof. An opening area 201*a* that is an opening of the penetration area 201 is formed in the inner side plane 122*b*. In the present embodiment, the penetration area 201 formed on a single side plate is composed of two window-like areas adjacent to each other. A beam 202 is formed between the two window-like areas along the conveying direction d2. The brushes 132 through 135 clean up four sides around the sheets P stacked and accommodated in the inner casing 122 through the opening areas 201*a*. The shape and size of the penetration area 201 are adjusted so that, while the brushes are rotating in the state shown in FIG. 3A maintained, the brushes can brush off the sheets P accommodated in the inner casing 122 and the uppermost stacked sheet Po of the sheets P.

[Suction Unit]

The sheet feeder 100 further includes a suction unit 211. The suction unit 211 includes an air intake port 211*a* and an air exhaust port 211*b* and further internally has a fan (not illustrated). Air is taken in through the air intake port 211*a* by rotation of the fan, and at the same time, taken-in air is exhausted through the air exhaust port 211*b*. The suction unit 211 is installed at the exterior of the outer casing 121, and taken-in air is exhausted to the exterior of the outer casing 121.

Figure 5:
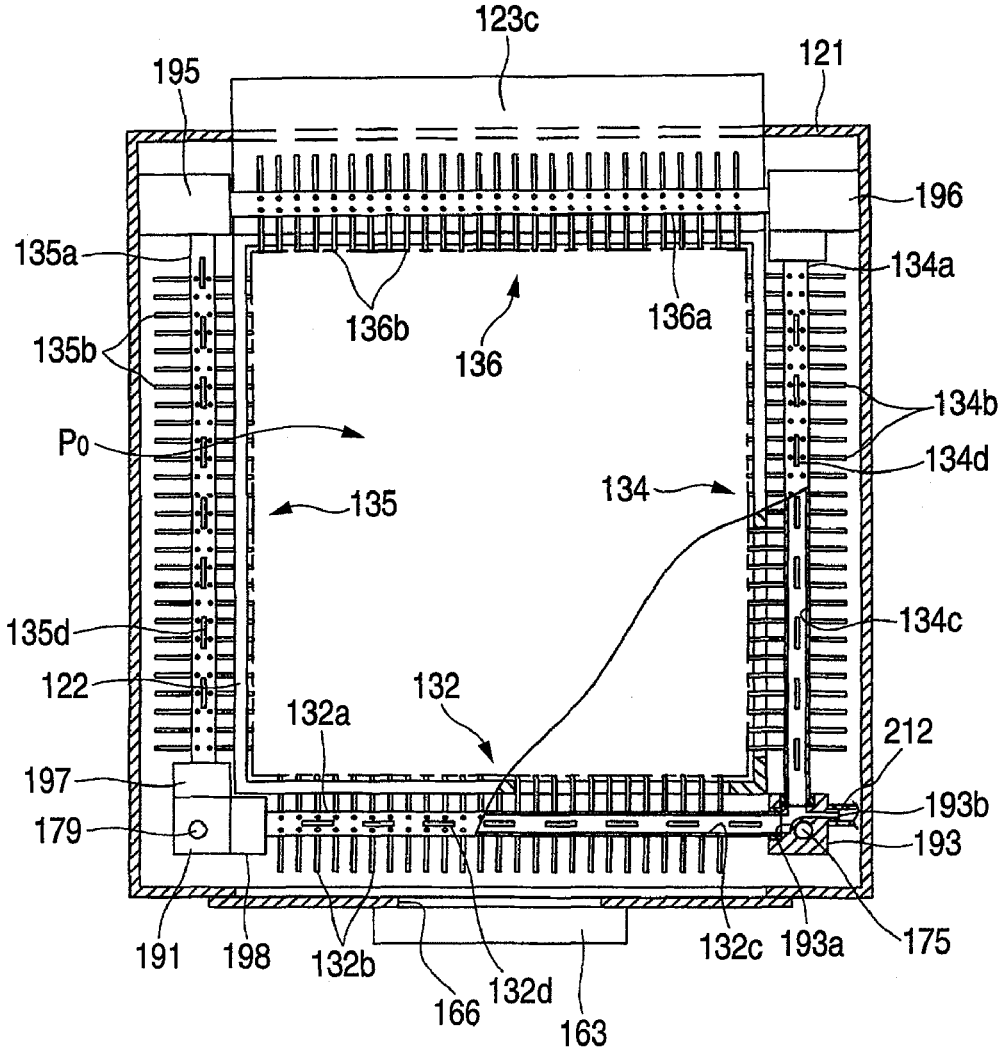
FIG. 5 is a partially sectional upper surface view showing the interior of the sheet feeder shown in FIG. 2.

The suction unit 211 is connected to the bearing 192 through a tube 212, wherein one end of the tube 212 is connected to the bearing 192 and the other end is connected to the intake port 211*a* of the suction unit 212. The suction unit 211 sucks in air in the interior of the brushes 132 through 135 through the tube 212 and the interior of the bearing 192. FIG. 5 is a view showing a further detailed structure of the brushes 132 through 135.

The brushes 132 through 135, respectively, include brush main bodies 132*a* through 135*a* and a plurality of brush hairs 132*b* through 135*b*. For example, the brush 132 includes a brush main body 132*a* and brush hairs 132*b*. The brush main body 132*a* presents a cylindrical shape, and a cavity 132*c* is formed in the interior thereof. The space 132*c* extends in the entire area in the lengthwise direction of the brush main body 132*a*, and is open to the exterior of the brush 132*a* at both ends of the brush 132*a*. The brush hairs 132*b* are perpendicularly fixed on the surface of the brush main body 132*a*. The length of the brush hairs 132*b* is adjusted to a length by which the tip ends of the brush hairs 132*b* can reach the sheets P accommodated in the inner casing 122 through the penetration area 201. A plurality of intake ports 132*d* are formed in the brush main body 132*a* along the lengthwise direction. The intake port 132*d* is a hole penetrating from the surface of the brush main body 132*a* to the internal space 132*c*. Any one of the brushes 133 through 135 other than the brush 132 has the same structure as that of the brush 132.

Also, the brush 136 also has a cylindrically shaped brush main body 136*a* and a plurality of brush hairs 136*b* as in the brush 132, etc., described above, The brush main body 136*a* extends parallel to the front end side in the conveying direction of the sheets P as shown in FIG. 5, and is formed longer than the front end side. The brush hairs 136*b* are perpendicularly fixed on the surface of the brush main body 136*a*, and arrayed in the lengthwise direction of the brush main body 136*a* and in the circumferential direction of the brush main body 136*a*. The brush hairs 136*b* are adjusted to a length by which the brush hairs are brought into contact with the sheet P when the sheet P fed by the feeding roller 112 is about to arrive at the feeding portion 123, and are arrayed so that the hairs can contact the entirety of the front end side of the sheet P.

A cavity is formed in the interior of the bearings 182 and 183, respectively. For example, as shown in FIG. 5, a cavity 193*a* is formed in the interior of the bearing 193. An opening 193*b* communicating with the exterior of the bearing 193 is formed on the surface of the bearing 193. The space 193*a* is formed so as to communicate with any one of the space 132*c* in the interior of the brush main body 132*a*, the space 134*c* in the interior of the brush main body 134*a* and the opening 193*b*. A tube 212 is connected to the opening 193*b*. Also, the bearing 192 has the same structure as that of the bearing 193, to which a suction unit similar to the suction unit 121 is connected via the tube 212.

According to the above-described construction, air in the interior of the brushes 132 through 135 is exhausted to the exterior of the outer casing 121 by the suction unit 211 through the cavity in the interior of the bearing and the tube 212. Therefore, foreign substances brushed off by the brushes 132 through 135 are sucked in through the suction ports formed in the brush main bodies 132*a* through 135*a* and are discharged to the exterior of the outer casing 121. Accordingly, foreign substances brushed off from the sheets by the brushes 132 through 135 can be prevented from being adhered to the sheets again.

Also, as a modified version, suction ports that are similar to those of the brushes 132 through 135 may be formed in the brush 136. In this case, a cavity communicating with the internal space of the brush 136 and an opening through which the space is caused to communicate with the exterior are formed in the bearing 196. A tube branched via a three-way valve from the tube 212 connected to the bearing 192 is connected to the opening of the bearing 195. With the construction, air can be sucked in through the suction ports of the brush 136 while commonly using the suction unit 211. For this reason, foreign substances on the printing surface, which are brushed off by the brush 136, can be sucked in through the suction port and can be exhausted.

[Control Section]

The printer 1000 includes a CPU (Central Processing Unit), a ROM (Read-only-memory), a RAM (Random Access Memory), and other hardware such as various types of interfaces, etc., all of which are not illustrated. The memory unit such as the ROM, etc., stores various types of software including programs by which the CPU is caused to function as the following control section. The following control section 300 is constructed by cooperation of the hardware and software.

Figure 6:
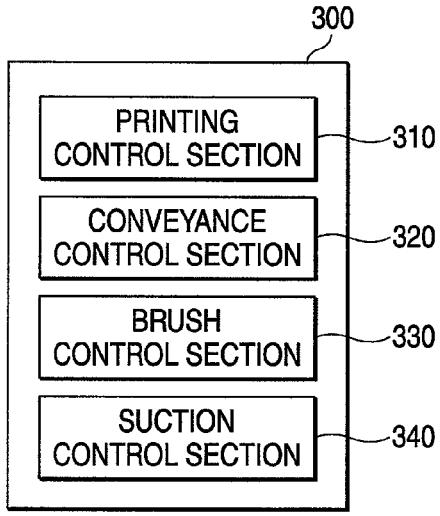
FIG. 6 is a block diagram showing a configuration of the printer control section shown in FIG. 1.

FIG. 6 is a block diagram showing a configuration of the control section 300. The control section 300 includes a printing control section 310, a conveyance control section 320, a brush control section 330 and a suction control section 340. The printing control section 310 controls the ink jet heads 401 through 404 based on image data from a personal computer connected to the printer 1000, and causes these heads to discharge desired inks corresponding to the image data.

The conveyance control section 320 controls conveyance of sheets by the accommodated sheet conveying unit 140, the feeding unit 110 and a sheet conveying unit 500. For example, by controlling the accommodated sheet conveying unit 140, sheets accommodated in the sheet feeder 100 between the sheet standby position of FIG. 3A and the sheet feeding position of FIG. 3B are moved to the accommodated sheet conveying unit 140 at a predetermined interval. Also, by controlling the feeding unit 110, sheets are fed from the sheet feeder 100 to the feeding unit 110 one after another at a predetermined interval. Or, by controlling the sheet conveying unit 500, sheets are conveyed to the sheet conveying unit 500 one after another to the ink discharge timing from the ink jet heads 401, etc.

The brush control section 330 controls rotation and movement of the brushes 132 through 136 by controlling the brush-turning motors 197 and 198, two brush-turning motors (not illustrated), and the ball screw turning motors 177 and 178. For example, the brushes are rotated and moved in response to predetermined timing such as the timing at which the power source of the printer 1000 is changed from OFF to ON.

The suction control section 340 sucks in foreign substances from the brushes at a predetermined timing by controlling the suction units 211 and another suction unit (not illustrated)

[Control Flow of Printer]

Figure 7:
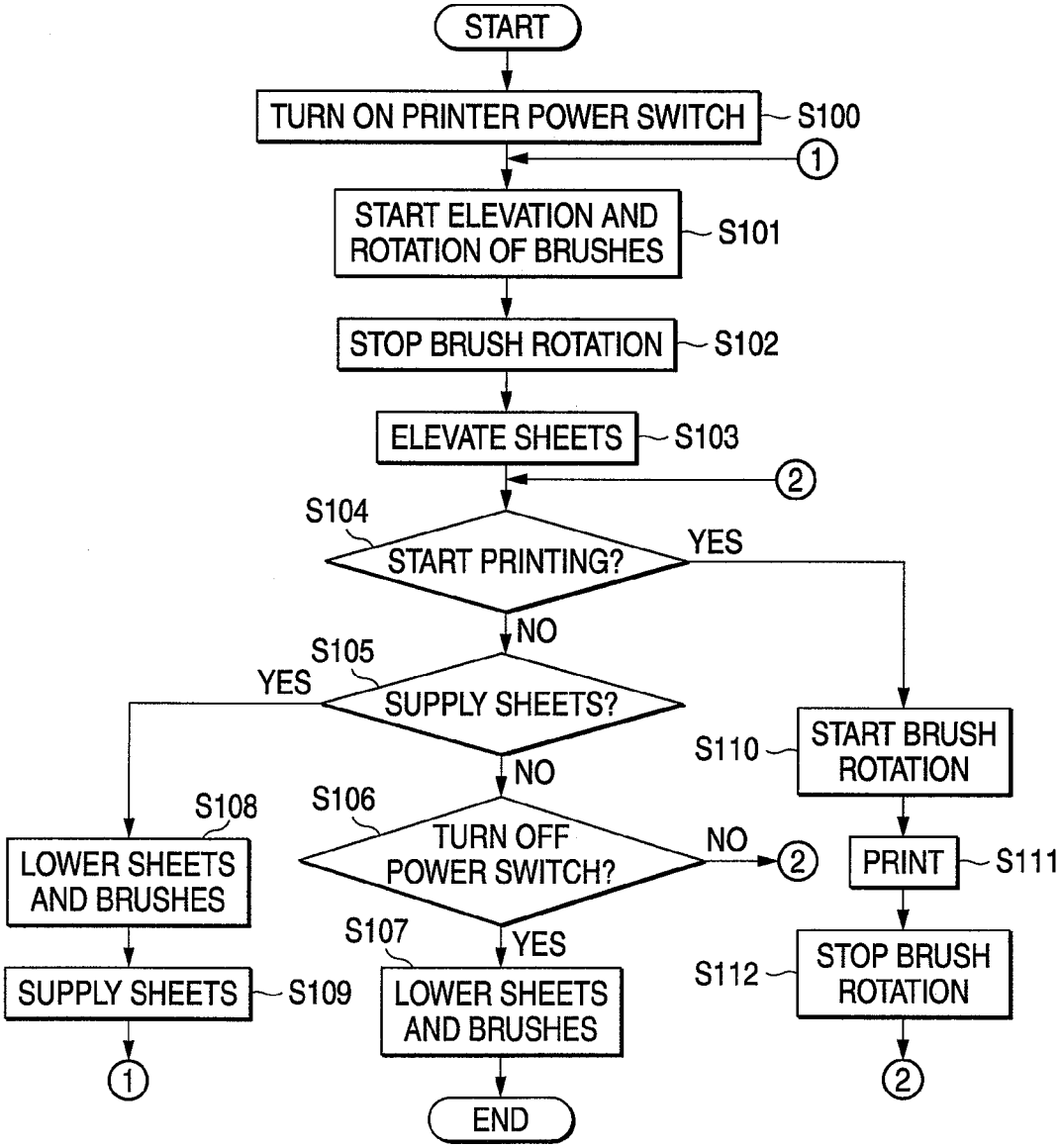
FIG. 7 is a flowchart showing movements of a printer and a series of flows of action and control from the time when the power source of the printer illustrated in FIG. 1 is turned on and the time when it is turned off.

FIG. 7 is a flowchart showing movements of the printer 1000 and a series of controls carried out by the control section 300 from the time when the power source of the printer 1000 is changed from OFF to ON to the time when the power source thereof is changed from ON to OFF.

First, in a state where the power source of the printer 1000 is turned off, the brushes 132 through 135 and the sheets P in the sheet feeder 100 are held in the sheet standby position and the brush standby position of FIG. 3A. Next, as the power source switch of the printer 1000 is turned on (S100), the brush control section 330 causes the brush-turning motor 197 and the ball screw-turning motor 177, etc., to rotate and move the brushes 132 through 135. The brushes 132 through 135 are moved (moved upwardly) from the brush standby position of FIG. 3A to the brush cleaning-up position of FIG. 3B while rotating the brushes 132 through 135 (S101). At this time, sheets accommodated in the sheet feeder 100 remains held at the sheet standby position of FIG. 3A.

Accordingly, the brushes 132 through 135 will clean up four sides of all the sheets in the sheet feeder 100. Therefore, the sheets will be cleaned up once before they are subjected to printing, wherein foreign substances adhered to the sheets can be further securely removed.

Next, as the brushes 132 through 135 move to the cleaning-up position of the brushes of FIG. 3A, the brush control section 330 stops rotation of the brushes (S102).

Next, the conveyance control section 320 causes the accommodated sheet conveying unit 140 to convey a sheet in the sheet feeder 100 from the sheet standby position to the sheet feeding portion (S103). Simultaneously therewith, the control section 320 causes the feeding unit 110 to prepare for feeding of sheets.

Further, the control section 300 judges whether an instruction of commencing printing is transmitted from a personal computer, etc., connected to the printer 1000 (S104). If the control section judges that the instruction of commencing printing has not been transmitted (S104, NO), the control section 300 judges whether the supply of sheets is commenced (S105). Herein, the supply of sheets means that a user of the printer 1000 supplies sheets to the interior of the sheet feeder 100 in a state where the printer 1000 does not carry out any printing operation. For example, if the supply port of sheets of the printer 1000 is provided with a coverlid, the user carries out operations of closing the coverlid after opening of the coverlid and supplying sheets. At this time, the control section 300 may judge whether the supply of sheets is commenced, by judging whether the coverlid is opened.

Where the control section 300 judges that supply of sheets has not been commenced (S305, NO), the control section 300 judges whether the power source switch is turned off (S106). Where the control section 300 determines that the power source switch is turned off (S106, YES), the conveyance control section 320 and the brush control section 330 cause the accommodated sheet conveying unit 140 to return the position of the sheets P and the brushes 132 through 135 from FIG. 3B to FIG. 3A (S107). Then, the control is completed. Where the control section 300 judges that the power source switch is not turned off (106, NO), the control section 300 carries out processing from S104.

On the other hand, where the control section judges in S104 that an instruction of commencing printing is transmitted (S104, YES), the brush control section 330 causes the brush-turning motors 197, etc., to commence rotation of all of the brushes 132 through 136 (S110). While the conveyance control section 320 is causing the feeding unit 110 and the sheet conveying unit 500 to convey sheets, the printing control section 310 causes the ink jet heads 401 through 404 to discharge inks for printing (S111). When the printing is completed, the brush control section 330 causes the brush-turning motor 197, etc., to stop rotations of the brushes 132 through 136 (S3112), and the control section 300 carries out processing from S104. At this time, in order to clean up a sheet that is the most upwardly stacked in the inner casing 122, that is, a sheet immediately before being fed from the sheet feeder 100 for printing, the brushes 132 through 136 carry out cleaning-up of the sheets at the positions where it is very rare that once brushed off foreign substances are adhered to the sheets again.

Also, where the control section 300 judges in S105 that supply of sheets has been commenced (S105, YES), the conveyance control section 320 and the brush control section 330 causes the accommodated sheet conveying unit 140, etc., to return the positions of sheets and brushes from FIG. 3B to FIG. 3A (S108). Where a user supplies sheets (S109) and the supply of sheets is completed, the control section 300 carries out processing from S101. That is, as in the case where the power source switch is turned on, the brushes 132 through 135 and the sheets P are moved to the position for printing. Further, judgment for whether supply of sheets has been completed may be based on judging whether the coverlid secured at the supply port of sheets is closed.

Thus, since, when sheets are supplied, the brushes 132 through 135 and the sheets are moved to the position of FIG. 3A, that is, the lowest position, sheets can be supplied to the maximum that can be accommodated in the sheet feeder 100, and the sheets can be supplied without any hindrance due to the brushes 132 through 135. In addition, since the brushes 132 through 135 clean up the sheets again immediately after the sheets are supplied (S101 and S102), there is no case where sheets to which foreign substances are adhered are fed from the sheet feeder 100 even if newly supplied sheets have foreign substances.

Suction of foreign substances by the suction control section 340 through the suction ports formed in the brush main bodies 132*a* through 135*a* may be carried out only while printing is being executed or may be continuously carried out from the time when the power source is turned on to the time when it is turned off.

As described above, in the present embodiment, sheets accommodated in the sheet feeder are cleaned up by the brushes 132 through 136 at the timing immediately after the power source is turned on or immediately after sheets are supplied, and at the timing immediately before the sheets are fed from the sheet feeder 100, that is, at least two timings. Therefore, it is possible to further securely remove foreign substances from sheets in comparison with a case where sheets are cleaned up only at either timing.

In addition, the printing surface of the sheet P is brushed off by the brush 136 until the sheet P reaches the positions opposed to the nozzle surfaces 401*a* through 404*a* from the sheet feeding position. Therefore, there is almost no case where sheets are conveyed to the positions opposed to the nozzle surfaces 401*a* through 404*a* with foreign substances adhered to the sheets. Accordingly, it is possible to prevent the discharge characteristics of ink from being lowered due to foreign substances adhered to the sheets being further adhered to the nozzle surfaces 401*a* through 404*a*. Additionally, since the brush 136 is disposed between the extreme end portion at the ink jet heads 401 through 404 side of the sheet P and the ink jet heads 401 through 404, a mechanism of moving the brush 136 so as to brush off the printing surface of the sheets P is no longer required, wherein the apparatus can be simplified.

Also, since the brush hairs 136*b* are brought into contact with the entirety of the front end side of the sheet P, it becomes possible to brush off the entire printing surface of the sheet P by the brush 136 until the sheet P reaches the position opposed to the nozzle surfaces 401*a* through 404*a*. Therefore, foreign substances are hardly adhered to the nozzle surfaces 401*a* through 404*a*. Also, since the sheet feeder 100 has the outer casing 121 to enclose the inner casing 122, the sheets P are almost doubly enclosed. For this reason, foreign substances outside the outer casing 121 are hardly adhered to the printing surface of the sheet P. Furthermore, since the brush 136 is provided in the outer casing 121, foreign substances outside the outer casing 121 are hardly adhered to the brush 136.

Also, since the brush 136 is disposed in the vicinity of the opening 123*d* in the outer casing 121, foreign substances are brushed off from the printing surface in the vicinity of the feeding portion 123, and sheets P are quickly fed through the opening 123*d*. Therefore, the foreign substances brushed off in the outer casing 121 are hardly adhered onto the corresponding printing surface. Further, since the through-hole 166 is formed at the position corresponding to the opening 123*d*, foreign substances brushed off from the printing surface by the brush 136 can be further easily flown out through the through-hole 166 by virtue of the air flows.

[Other Embodiments of Sheet Feeder]

Hereinafter, other embodiments of the sheet feeder will be described. Incidentally, since the configuration of the printer other than the sheet feeder is the same as that of the above-described embodiment, detailed description thereof is omitted.

Figure 8:
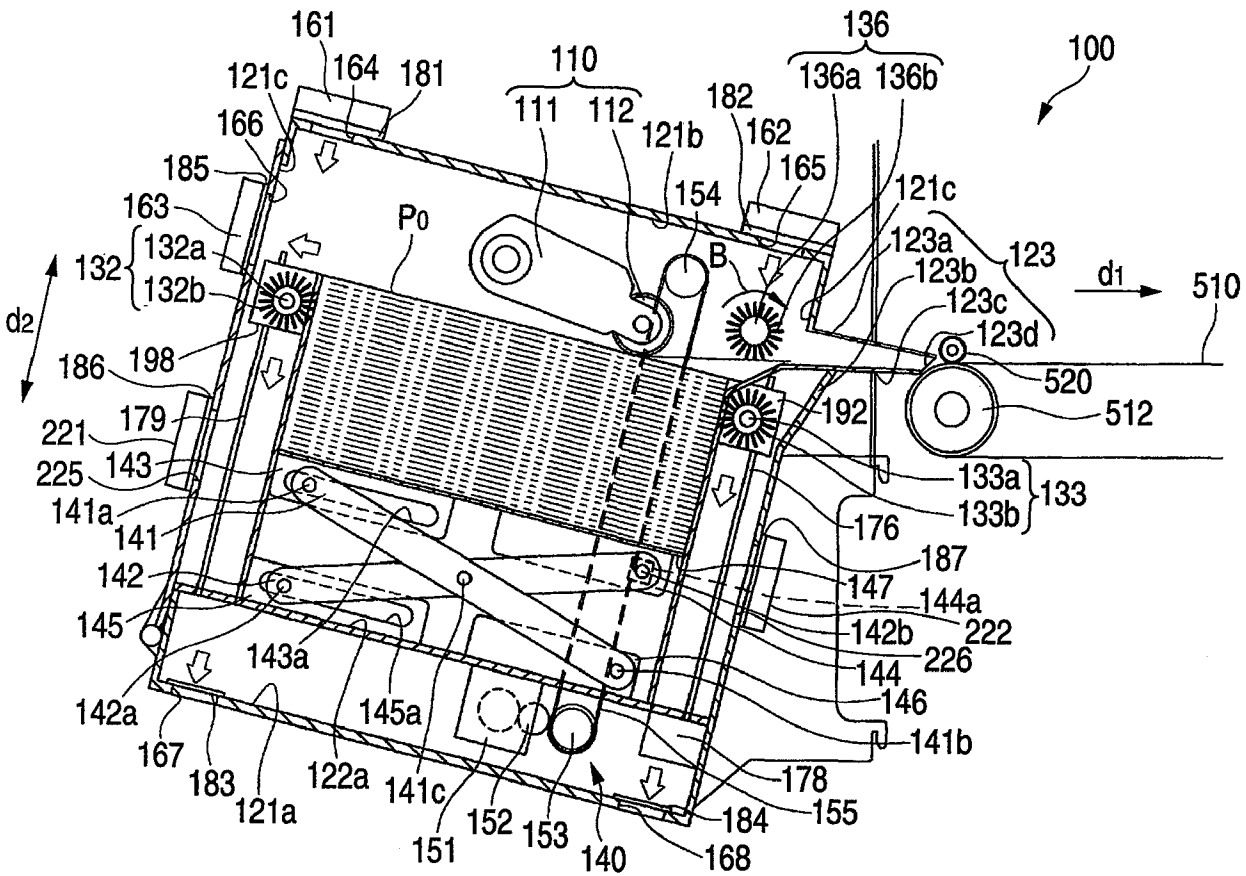
FIG. 8 is a view showing an internal configuration of another sheet feeder.
Figure 9:
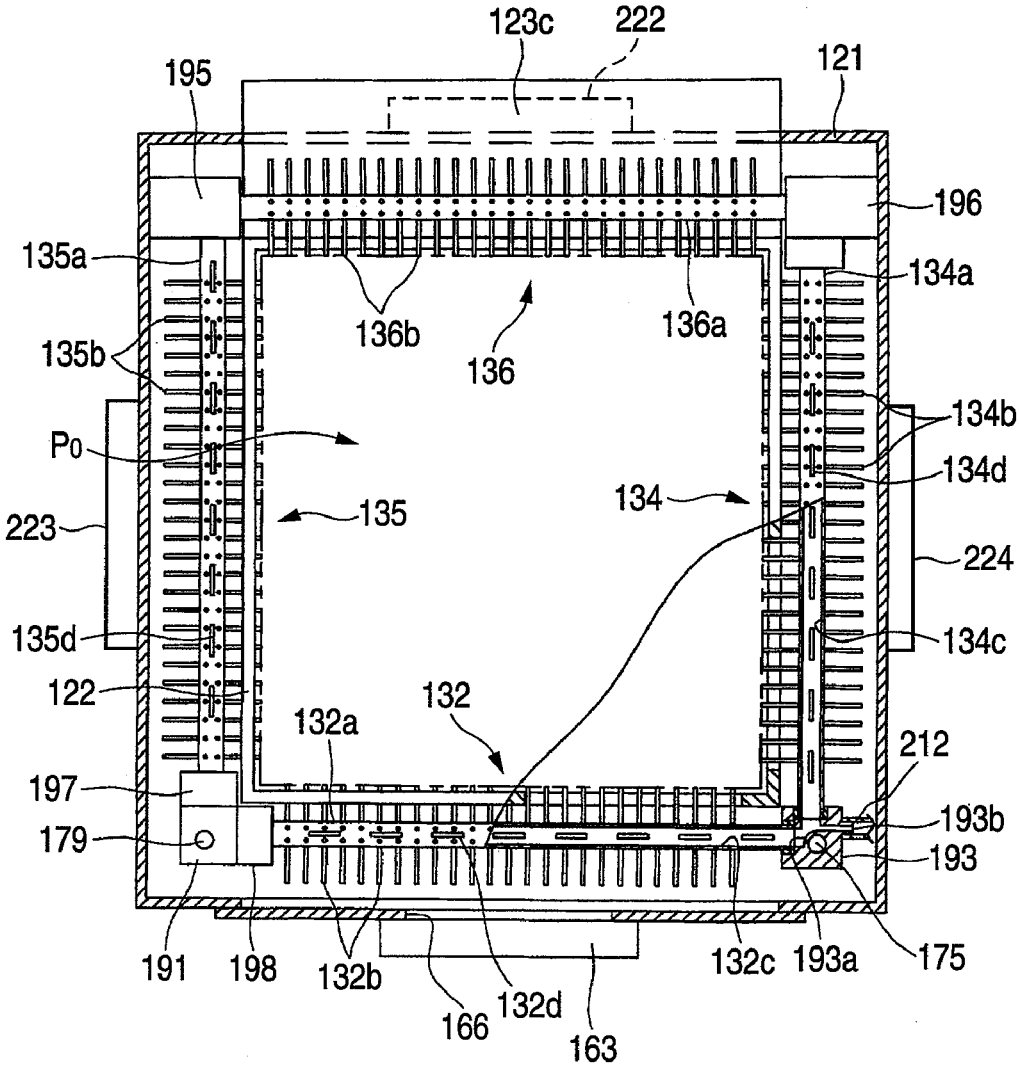
FIG. 9 is a partially sectional upper surface view showing the interior of the sheet feeder shown in FIG. 8.

FIGS. 8 and 9 are views showing other embodiments of the sheet feeder.

As shown in FIG. 8*r* the sheet feeder 100 further includes exhaust fan units 221 through 224. Through-holes 225 and 226 are also formed in the side plates of the outer casing 121. Further, through-holes (not illustrated) are formed in two side plates different from the side plates in which the through-holes 225 and 226 are formed.

The through-holes 225 and 226 are, respectively, formed at positions opposed to the inner side 122*b* of the inner casing 122. The through-holes 225 and 226 are formed on the two inner sides 121*c*, opposed to each other, of the outer casing 121. One through-hole (not illustrated) is formed, at the position opposed to the inner side 122*b* of the inner casing 122, in the two inner sides 121*c* separate from the inner side 121*c*, in which the through-holes 225 and 226 are formed, of the four inner sides of the outer casing 121, respectively.

Further, the exhaust fan units 163 and 211 through 224 are installed so as to cross over five openings in total, which includes the through-holes 166, 225 and 226 formed on the outer surface of the outer casing 121. The exhaust fan units 163, 221 and 222 internally have a fan (not illustrated), respectively. By rotating the internal fans, air flows are generated, which cause air in the outer casing 121 to flow outwardly through the through-holes 166, 225 and 226. In other words, pressure is applied to air in the vicinity of the external openings of the through-holes 166, 225 and 226 by rotations of the fans (not illustrated), so that air is moved farther from these through-holes. That is, if the exhaust fan unit 163 is driven, air flows flowing along the upper surface of sheets P from the vicinity of the brush 136 disposed adjacent to the feeding portion 123 is guided to the outside of the outer casing 121.

Air flows as shown by white-outlined arrows in FIG. 8 are generated inside the outer casing 121 by the through-holes 164 through 168, 225 and 226 and fan units 161 through 163 and 221 through 224. That is, air at the exterior of the outer casing 121 is flown into the outer casing through the through-holes 164 and 165 by the intake fan units 161 and 162. Air is oriented mainly downward from there along the inner casing 122 between the inner side 121*c* of the outer casing 121 and the inner casing 122, and is flown outwardly through the through-holes 167 and 168. Therefore, foreign substances brushed off from sheets P by the brushes 132 through 135 and foreign substances adhered to the peripheries of sheets P are conveyed by downward air flows, and are discharged to the outside of the outer casing 121 through the through-holes 167 and 168.

Furthermore, by air flows generated by the exhaust fan units 221 and 222, air located between the side plates of the inner casing 122 and the inner sides 121*c* of the outer casing 121 are flown out through the through-holes 225 and 226. Therefore, foreign substances brushed off from the sheets P by the brushes 132 and 133 are conveyed by the air flows generated by the exhaust fan units 221 and 222 and are exhausted outward of the outer casing 121 through the through-holes 225 and 226. The through-holes 225 and 226 are formed in the inner sides 121*c* of the outer casing 121, and are closer to the inner sides 122*b* than the through-holes 166 through 168 formed in the ceiling plane 121*b* and the bottom plane 121*a*. Therefore, it becomes easy that foreign substances brushed off by the brushes 132 and 133 via the inner sides 122*b* are discharged through the through-holes 225 and 226. In addition, since the through-holes 225 and 226 are formed in the area opposed to the inner sides 122*b* on the inner sides 121*c*, they are closer to the inner sides 121*a* than in the case where they are formed in the area not opposed to the inner sides 121*a*. Accordingly, it becomes easier that the foreign substances are discharged.

Also, as described above, two through-holes (not illustrated) and exhaust fan units 223 and 224 are installed in two inner sides 121*c* separate from the inner sides 121*c*, having the through-holes 225 and 226 formed therein, of the four inner sides 121*c* of the outer casing 121. Foreign substances brushed off by the brushes 134 and 135 via the inner side 122*b* of the inner casing 122, which is opposed to the through-holes, are discharged outward of the outer casing 121 by the air flow generated by the exhaust fan units 223 and 224.

In addition, the through-holes 164 and 165 are formed n the ceiling plane 121*c* opposed to the printing surface of sheets P accommodated in the inner casing 122. Further, the through-holes 167 and 168 are formed in the bottom plane 121*a* opposed to the side opposite the printing surface of the sheets P accommodated in the inner casing 122. Therefore, in comparison with the case where these through-holes are formed in the inner sides 121*c* not opposed to the printing surface, it becomes easier that air flows occur, which is oriented from the upper part of the outer casing 121 downward along the sides of the inner casing 122. Accordingly, foreign substances brushed off by the brushes 132 through 135 along the sides of the inner casing 122 are easily conveyed along with the air flows.

In this embodiment, the control section 300 shown in FIG. 6 includes a suction and exhaust control section 340. The suction and exhaust control section 340 controls the suction unit 211 and another suction unit (not illustrated) and sucks in foreign substances from the brushes at predetermined timing. Also, by controlling the intake fan units 161 and 162 and the exhaust fan units 163 and 221 through 224, air flows are generated in the interior of the outer casing 121 at predetermined timing.

The suction and exhaust control section 340 may cause the suction ports, which are formed in the brush main bodies 132*a* through 135*a*, to absorb foreign substances only while printing, or may continuously cause the same to absorb from turning-on of the power source to turning-off. Also, the suction and exhaust control section 340 may drive the intake fan units 161 and 162 and the exhaust fan units 221 through 224 only while the brushes 132 through 136 are being turned or may drive the same from turning-on of the power source to turning-off thereof.

[Other Embodiments of Outer Casing]

Hereinafter, other embodiments of the outer casing will be described. Incidentally, since the configuration of the printer other than the outer casing is the same as that of the above-described embodiment, detailed description thereof is omitted.

Figure 10:
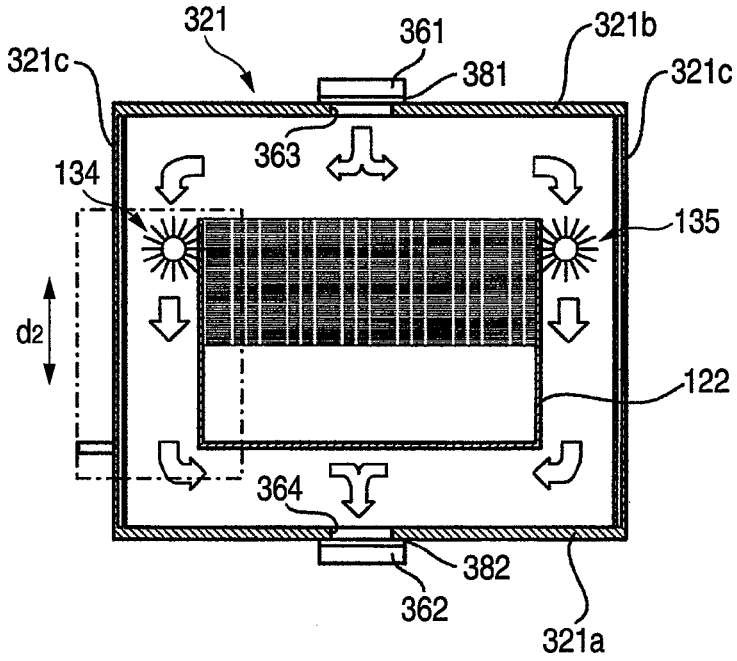
FIG. 10 is a perspective view showing other outer casing.
Figure 11A:
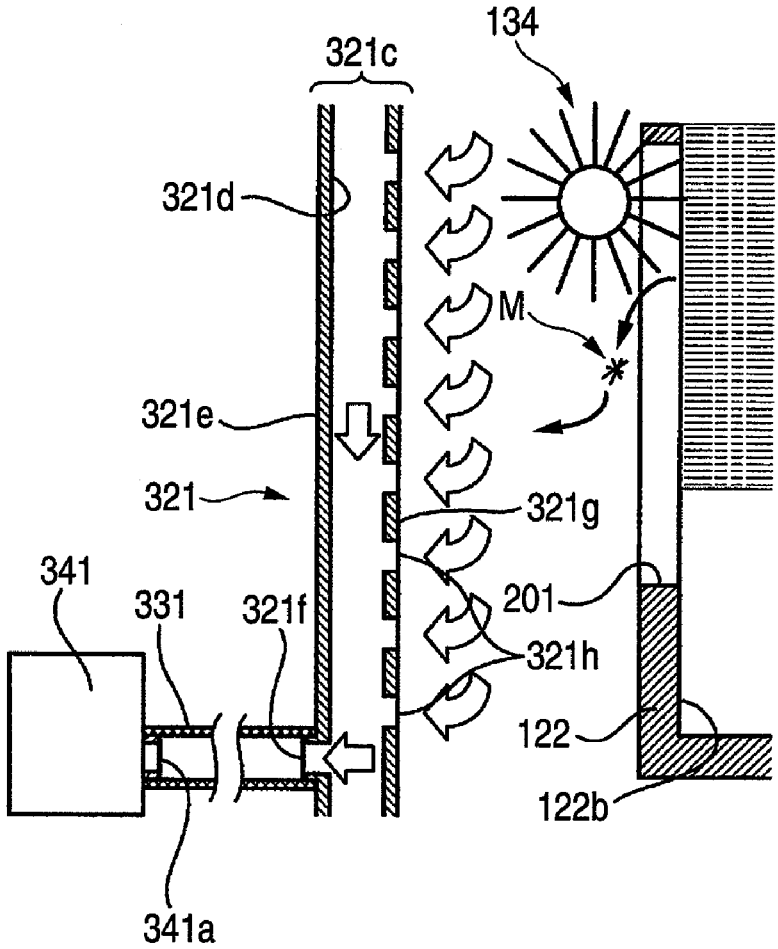
FIGS. 11A and 11B are enlarged views of an area encircled by an alternate long and short dash line in FIG. 10.

FIG. 10 is a schematic view showing the outer casing 321 according to another embodiment. FIG. 11A is an enlarged view showing the area encircled by an alternate long and short dash line in FIG. 10. Also, as in the above-described embodiment, sheets P accommodated in the inner casing 122 are conveyed along the conveying direction d2 by the accommodated sheet conveying unit 140. For convenience of description, illustration of the accommodated sheet conveying unit 140 and the second-off unit 110 is omitted.

The outer casing 321 according to the present embodiment is roughly a parallelepiped. The outer casing 321 includes a bottom plate 321*a* of roughly a rectangular shape and a ceiling plate 321*b* opposed to the bottom plate 321*a* and having the shape and size similar to those of the bottom plate 321*a*. Further, four side plates 321*c* in total (wall plates) that are perpendicularly erected from the respective sides of the bottom plate 321*a* and connect the respective sides of the bottom plate 321*a* to the respective sides of the ceiling plate 321*b* are installed at the outer casing 321. These four side plates 321*c* are also roughly rectangular.

A through-hole 363 (first inflow port) is formed in the ceiling plate 321*b* of the outer casing 321. The through-hole 363 is formed almost at the middle of the ceiling plate 321*b* in a plan view perpendicular to the conveying direction d2. A through-hole 364 (outflow port) is formed in the bottom plate 321*a* of the outer casing 321. The through-hole 364 is formed at the position opposed to the through-hole 363 with respect to the conveying direction d2. An intake fan unit 361 and an exhaust fan unit 362 are further installed in the outer casing 321. The intake fan unit 361 is installed on the upper surface of the ceiling plate 321*b* so as to cross over the through-hole 363. The exhaust fan unit 362 is installed on the underside of the bottom plate 321*a* so as to cross over the through-hole 364.

The intake fan unit 361 and the exhaust fan unit 362 internally have a fan (not illustrated). The intake fan unit 361 generates air flows by rotating the internal fan so that air at the exterior of the outer casing 321 is flown into the interior through the through-hole 363. In other words, pressure is applied by rotations of the fan so that air in the vicinity of the opening at the exterior of the through-hole 363 is oriented to the interior of the through-hole 363, whereby the atmospheric pressure in the outer casing 321 is made into positive pressure. The exhaust fan unit 362 generates air flows by rotating the internal fan so that air in the interior of the outer casing 321 is flown outward through the through-hole 364. In other words, pressure is applied by rotations of the fan so that air in the vicinity of the opening of the exterior of the through-hole is moved farther from the through-hole 364.

Filters 381 and 382 are, respectively, installed between the intake fan unit 361 and the through-hole 363 and between the exhaust fan unit 362 and the through-hole 364. A plurality of ventilation ports are formed in the areas opposed to the through-holes 363 and 364 in the filters 381 and 382. Foreign substances in air are removed when air passes through these ventilation ports. That is, air passing through the through-holes 363 and 364 is filtrated when passing through the filters 381 and 382.

Also, the filter 382 the mesh of which is coarser than the mesh of the filter 381 is used. The filter 382 is installed mainly so that foreign substances do not enter from the exterior of the outer casing 321 through the through-hole 364. It is not necessary that the mesh of the filter 382 is so fine. By employing a coarse-meshed filter as the filter 382, ventilation to the outside of the outer casing is not hindered.

As shown in FIG. 11A, a cavity 321*d* is formed in the interior of the side plate 321*c* of the outer casing 321. An opening 321*f* (outflow port) of the cavity 321*d* and openings 321*h* (second inflow ports) thereof are formed in the outer surface side 321*e* and the inner surface side 321*g* of the side plate 321*c*, respectively. The openings 321*h* are formed in a plurality at areas opposed to the inner casing 122 on the inner surface 321*g*. One end of the tube 331 is connected to the opening 321*f*. On the other hand, a suction unit 341 is installed at the exterior of the outer casing 321. The other end of the tube 331 is connected to the suction port 341*a* of the suction unit 341. The suction unit 341 causes air, which is sucked in through the suction port 341*a*, to be discharged through the exhaust port (not illustrated) by rotating an internal fan (not illustrated). Therefore, air flows are generated, by which outside air of the outer casing 321 is caused to flow into the interior thereof through the tube 331. In other words, pressure is applied to air in the vicinity of the exterior opening of the opening 321*f*, so that the air is moved farther from the opening 321*f*.

With the above-described construction, air flows as shown by white-outlined arrows in FIG. 10 are generated in the interior of the outer casing 321. Air flown into the interior of the outer casing 321 through the through-hole 363 is oriented to the side plate 321*c* of the outer casing 321 along the ceiling plate 321*b* at the upper part of the inner casing 122. Air that has reached the side plate 321*c* of the outer casing 321 is oriented to the downward along between the side plate 321*c* and the inner casing 122. Air that has reached the bottom plate 321*a* of the outer casing 321 is oriented to the through-hole 364 along the bottom plate 321*a*. Air that has reached the through-hole 364 is flown to the outside of the outer casing 321 through the through-hole 364.

Air flows as shown by white-outline arrows in FIG. 11A are generated in the vicinity of the side plate 321*c*. If the suction unit 341 operates, air in the cavity 321*d* is sucked in through the opening 321*f* via the tube 331. Therefore, air flows are generated in the cavity 321*d*, which is oriented to the opening 321*f*. Air flows are also generated in the vicinity of the opening 321*f*, which is oriented from the opening 321*f* to the interior of the tube 331. On the other hand, air inside the inner surface side 321*g* of the side plate 321*c* is flown into the cavity 321*d* through the opening 321*h* in line with outflow of the air in the cavity 321*d* through the opening 321*f*.

Also, any one of four side plates 321*c* of the outer casing 321 has a construction as shown in FIG. 11A. And all of these cavities formed in the four side plates 321*c* are caused to communicate with each other, wherein air is sucked in from all the cavities by a single suction unit 341.

Based on the above-described construction, foreign substances M brushed off by the brushes 132 through 135 through the opening area 201 of the inner casing 122 are discharged outside the outer casing 321 by the suction unit 341 through the opening 321*h*, cavity 321*d*, opening 321*f* and tube 331 as shown in FIG. 11A. Therefore, foreign substances brushed off by the brushes 132 through 135 are prevented from being adhered to sheets P again.

Further, the opening 321*h* is formed in the inner surface side 321*g* of the side plate 321*c* opposed to the inner side 122*b*. Therefore, foreign substances brushed off by the brushes 132 through 135 are further likely to enter the opening 321*h* than in the through-hole 364 formed in the bottom plate 321*a* not opposed to the inner side 122*b* of the inner casing 122. Further, foreign substances are further likely to enter some of the openings 321*h*, which are opposed to the opening area 201 formed in the inner casing 122, than in those of the openings 321*h* not opposed to the opening area 201. The reason why is as follows; In the following, differences between the openings 321*h* opposed to the opening area 201 and those not opposed thereto. A similar reason can be established between differences between the through-hole 364 and the opening 321*h*.

Figure 11B:
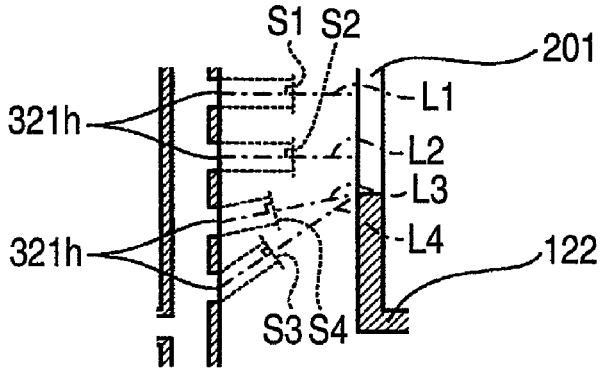

As shown in FIG. 11A, some of the openings 321*h* are opposed to the opening area 201 formed in the side plate of the inner casing 122 FIG. 11B is a view showing the positional relationship between the opening area 201 and the opening 321*h*. The upper two openings of the four openings 321*h* shown in FIG. 11B are opposed to the opening area 201, the lower two openings thereof are not opposed thereto. Alternate long and short dash lines L1 and L2 show linear segments of connecting the respective openings 321*h* to the opening area 201 at the shortest distance. In addition, areas S1 and 52 show projection areas in which the respective openings 321*h* are projected from the direction along the segments L1 and L2 to the plane perpendicular to the segments L1 and L2.

As shown with the segments L1 and L2, not only the openings, opposed to the opening area 201, of the openings 321*h* are closer to the opening area 201 than those, not opposed to the opening area 201, of the openings 321*h*, but also the area of areas S1 and S2 of the openings, opposed to the opening area 201 of, the openings 321*h* are greater than the area of areas S3 and S4 or the openings not opposed to the opening area 201. That is, since the openings 321*h* opposed to the opening area 201 have larger effective areas of an area opened toward the opening area 201, foreign substances brushed off by the brushes 132 through 135 through the opening area 201 are likely to flow in.

Further, differing from the above-described embodiment, the present embodiment includes through-holes 363 and 364 in the ceiling plate 321*b* and the bottom plate 321*a* of the outer casing 321, respectively. However, the through-holes 363 and 364 are not only opposed to the printing side of the sheets P accommodated in the inner casing 122 and the side opposite the printing side thereof, but also are positioned at almost the middle of the ceiling plate 321*b* the bottom plate 321*a*, respectively in its plan view perpendicular to the conveying direction d2. Therefore, air flows evenly oriented downward along the four sides of the inner casing 122 are generated.

[Other Embodiments of Inner Casing]

Hereinafter, other embodiments of the inner casing will be described. Incidentally, since the configuration of the printer other than the inner casing is the same as that of the above-described embodiment, detailed description thereof is omitted.

Figure 12A:
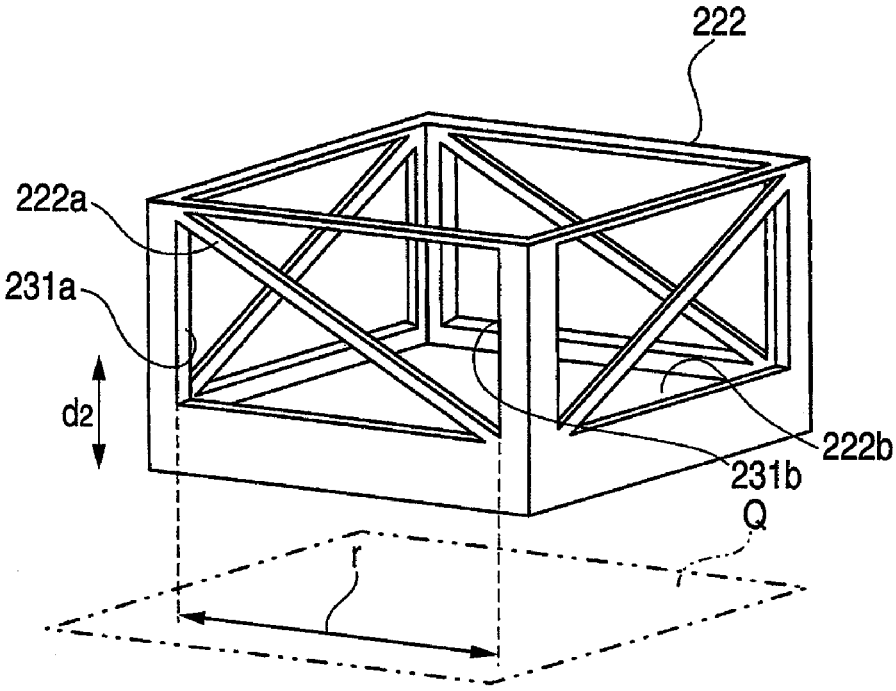
FIGS. 12A and 12B are perspective views showing another inner casing.
Figure 12B:
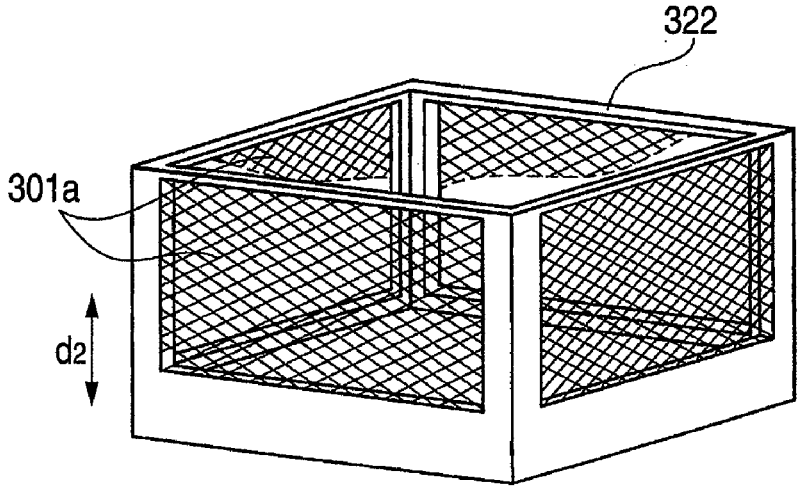

FIG. 12A and FIG. 12B are views showing other embodiments pertaining to the inner casing, which differs from the inner casing described above. The rough shape of the inner casing 222 is a parallelepiped as in the inner casing 122. However, penetration areas whose shape is different from the penetration area 201 of the inner casing 122 are formed in the respective side plates. A penetrating area formed in the respective side plates is composed of two areas 231*a* and 231*b*. The areas 231*a* and 231*b* present right-angled triangles whose size and shape are identical to each other. The two right-angled triangles are disposed so that two sides at both sides of the right angle are formed so as to become parallel to two sides of the side plate, and the areas 231*a* and 231*b* are formed in the side plate so that the diagonal sides thereof are opposed to each other. A beam 222*a* is formed between the areas 231*a* and 231*b*. In other words, the inner casing 222 has rectangular-shaped penetration areas formed in the respective side plates, and a beam is formed so as to cross the penetration area along the diagonal line.

On the other hand, in the embodiment described above, the penetration area 201 is composed of two areas. However, the two areas of the penetration area 201 are separated from each other by a beam portion 202 parallel to the conveying direction d2 (Refer to FIG. 4). In contrast, the beam portion 222*a* formed between the areas 231*a* and 231*b* is not parallel to the conveying direction d2. Based on such a difference in structure, the construction of the inner casing 222 is more preferable than that of the inner casing 122 in view of the following points.

Sheets accommodated in the inner casing are cleaned up at least two times by the brushes 132 through 135 before being subjected to printing. As shown in S101 in FIG. 7, the sheets are cleaned up by the brushes 132 through 135 when the power source is turned on and cleaned up by the brushes 132 through 135 immediately before the sheets are fed from the inner casing. Where the inner casing 122 is employed for the sheet feeder 100, since the beam portion 202 that is parallel to the conveying direction d2 is formed in the interior of the penetration areas 201, areas opposed to the beam portion 202 in the sheets are not brushed off by the brushes 132 through 135 even in the first cleaning time and the second cleaning time.

On the other hand, where the inner casing 231*a* is employed in the sheet feeder 100, when sheets are located at different positions in the conveying direction d2, the areas opposed to the beam portion 222*a* in sheets will differ from each other. Therefore, the area not brushed off by the brushes 132 through 135 after cleaning it up two times is further narrowed in comparison with the case where the inner casing 122 is employed. That is, the area brushed off by the brushes 132 through 135 in sheets before being subjected to printing is wider in the case where the inner casing 222 is employed than in the case where the inner casing 122 is employed. Therefore, when sheets are fed from the sheet feeder 100, it is possible to further securely prevent foreign substances from remaining adhered to the sheets.

As described above, the area brushed off by the brushes 132 through 135 being secured is based on the penetration areas composed of areas 231*a* and 231*b* that integrally exist over the range r. That is, this is because the projection areas projected from the direction perpendicular to the bottom plane 222*b* (that is, the direction parallel to the conveying direction d2) to the plane Q parallel to the bottom plane 222*b* of the inner casing 222 (that is, parallel to the sheets in the inner casing 222) are made into an integrated area over the range r (Refer to FIG. 12A). In contrast, if the penetration 201 is projected to the plane Q, the projection area is separated to be two areas.

Accordingly, in the inner casing 122 in which the penetration area 201 is formed, there will exist areas that cannot be brushed off by the brushes even if cleaning-up of sheets is repeated several times. In contrast, where the projection areas are integrated, the areas brushed off by the brushes 132 through 135 through the opening areas on four sides of sheets is widened when the sheets move, for example, between a state shown in FIG. 3B and a state shown in FIG. 3A, This is because the entire area in which one side of a sheet is opposed to the penetration area is made wider in the case where the projection areas are integrated than in the case where the projection areas are not integrated.

FIG. 12B shows still another embodiment of the inner casing. A plurality of wires are stretched in the penetration areas formed on side plates of the inner casing 322. These wires are to stabilize the shape of the inner casing 322 and to protect sheets accommodated therein. These wires are not parallel to the conveying direction d2, and as in the beam 222*a* in FIG. 12A, the wires do not hinder cleaning-up of the sheets by the brushes. Thin and slender beams may be provided instead of the wires.

<Modified Examples>

As described above, a description was given of a preferred embodiment of the invention. However, the invention is not limited to the embodiment described above, and may be subjected to various modifications and variations within the scope of Claims. For example, the brush 136 in the above-described embodiment brushes off foreign substances of conveyed sheets P by rotations. It may not rotate. That is, the brush may be fixed so as not to rotate, wherein it is sufficient that the brush hairs are brought into contact with the printing surface of the conveyed sheets P. Also, such a brush may be employed, in which brush hairs are fixed on one side of the brush main body whose section is square, and the brush turns around the axis passing through the center of the section and carries out swinging motions. In this case, it is possible to effectively brush off foreign substances from the printing surface as in the rotating brush 136. Also, it is not necessary that the brush 136 is provided in the vicinity of the opening 123*c*. For example, the brush 136 may be provided between the position opposed to the printing surface of the sheets P located at the feeding position of sheets and the ink jet heads so that the brush hairs are brought into contact with the printing surface of the sheets P. That is, the brush 136 may be provided at any position, where the brush hairs can be brought into contact with the printing surface of the sheets P, between the sheet feeding position and the printing position. Also, the brush 136 may be such that it is partially brought into contact with one side of the printing surface orthogonal to the conveying direction d1. That is, it may not be brought into contact with the entirety of one side of the printing surface. There may be cases where sheets P are conveyed while sides parallel to the conveying direction d1 are being rubbed with any portion of the conveying path on the way of conveyance. At such a time, dusty substances and foreign substances are generated from the sheets P. For this reason, it is sufficient that, for example, the brush 136 is provided so as to be brought into contact with only the vicinity of both sides parallel to the conveying direction d1. Thereby, since the vicinities of the respective sides are cleaned up by the brush 136 in advance, it is possible to prevent in advance the discharge characteristics of ink from being worsened due to dusty and foreign substances. Further, the brush 136 may be provided with suction ports which are similar to those of the brushes 132 through 135. In this case, a cavity communicating with the internal space of the brush 136 and an opening by which the space is caused to communicate with the outside are provided in the bearing 195. A tube branched via a three-way valve from the tube 212 connected to the bearing 192 is connected to the opening of the bearing 195. With such a construction, air can be sucked in through the suction port of the brush 136 while making the suction unit 211 conjugate. Therefore, foreign substances on the printing surface, which are brushed off by the brush 136, are sucked in through the suction ports and are exhausted. In addition, since a single suction unit 211 is made conjugate, this contributes to downsizing of the apparatus. Also, the outer casing may not be provided with through-holes 164, 165 and 166, and the intake fan units 161, 162 and exhaust fan units 163 may not be provided. Furthermore, the outer casing 121 may not be provided. Also, in the above-described embodiment, a printer having color ink jet heads is assumed. However, the present invention may be applicable to a monochrome printer or printer having a thermal transfer system employed therein. Still further, the ink jet heads may be movable.

Also, in the above-described embodiments, the four sides of the sheets are brushed off only one time by the brushes 132 through 135 at the timing when the power source is turned on. However, the brushes may reciprocate several times.

Also, in the above-described embodiments, the brushes 132 through 135 move between the position shown in FIG. 3A and the position shown in FIG. 3B at the timing when the power source is turned on and off. However, the brushes 132 through 135 may be fixed at the position shown in FIG. 3B. Or the brushes 132 through 135 may be fixed at the cleaning-up position of FIG. 3A. That is, the cleaning-up position by the brushes 132 through 135 may be any position along the side of the inner casing 122.

Four brushes are provided so as to correspond to the four sides of sheets in the above-described embodiments. However, in the invention, one or more brushes may be provided around the sheets. That is, in the invention, it is sufficient that one side of the sheets is brushed off at least immediately before the sheets are fed from the sheet feeder 100, or it is sufficient that a pair of brushes 134 and 135 are disposed parallel to the conveying direction. The sheets P may be conveyed while the side parallel to the conveying direction is brought into contact with any position of the conveying path on the way of conveyance. In such a case, dusty and foreign substances are generated from the sheets P. However, if the peripheries of respective sides are cleaned up by the brushes 134 and 135 in advance, the discharge characteristics of inks can be prevented from being worsened due to dusty and foreign substances.

In the above-described embodiments, all of the brushes 132 through 135 disposed at four sides of the sheets, brush 136 for cleaning up the printing surface of the sheets, intake fan units 161 and 162 for generating air flows for exhausting foreign substances inside the outer casing 121 to the exterior thereof, and a suction unit for sucking in foreign substances through suction ports formed in the brush main bodies are combined, where an ultimate effect of preventing sheets from being subjected to printing with foreign substances remaining adhered thereto can be displayed. As a matter of course, only some thereof may be combined. For example, a pair of brushes 134 and 135 disposed parallel to the conveying direction, brush 136, and intake fan units 161 and 162 may be combined, wherein sides of the sheets, from which dusty and foreign substances are likely to be generated during conveyance of sheets, are cleaned up, and at the same time, the foreign substances brushed off by the brushes 134, 135 and 136 are effectively exhausted to the outside. Further, the intake fan units 161 and 162 may be removed from the above-described construction. Even in this case, it is possible to feeding sheets whose surface is purified.

In the above-described embodiments, the outer casings 121,321 and the inner casing 122 are roughly a parallelepiped. However, they may have a shape differing from the above. For example, although the inner wall sides of the respective casings present a parallelepiped, the outer surface thereof may be columnar. Also, although the inner side 121*c* of the outer casing 121 is parallel to the inner side 122*b* of the inner casing 122, and the bottom surfaces thereof are parallel to each other, it is not necessary that these members are parallel to each other.

Further, in the above-described embodiments, the through-holes formed in the outer casings 121 and 321 may be various. For example, although the through-holes 164 and 165 that are inflow ports of air in the outer casing 121 are not opposed to the printing side of sheets P, the through-hole 363 of the outer casing 321 is opposed to the printing side of sheets P. In addition, the through-hole 225 that is one of the outflow ports of air in the outer casing 121 is formed in the inner side 121*c*, no through-hole is formed in the side plate 321*c* of the outer casing 321. The combination of such through-holes is not limited to the combinations shown in FIG. 8 and FIG. 10. For example, an outer casing may be employed for the invention, in which through-holes are formed at the middle of the ceiling plate like the through-hole 363 of the outer casing 321, and at the same time, a through-hole is formed in the side plates like the through-hole 225 of the outer casing 121.

In either of the above-described embodiments, one or more intake fan units and exhaust fan units are installed. However, it may be sufficient that at least either one is provided, and a fan unit is installed so that air is caused to flow in the outer casing. That is, even if any number of fan unit is installed by any connection method at any position, it is sufficient if such a construction is achieved, in which as the fan unit is actuated, air can be flown in the outer casing based on air flows generated by the fan unit.

What is claimed is:

1. A printing apparatus comprising;

a medium casing which accommodates at least one printing medium in a stack manner;

an accommodated medium conveying unit which conveys the at least one printing medium accommodated in the medium casing from a first medium standby position to a second medium standby position;

a feeding unit which feeds an outermost printing medium of the at least one printing medium conveyed to the second medium standby position from the medium casing;

a printing medium conveying unit which conveys the fed printing medium from the feeding unit to a printing position;

a print head which is disposed at a position opposed to the printing position and carries out a printing process on a printing surface of the conveyed printing medium; and a brush which brushes off the printing surface of the printing medium at a position between the second medium standby position and the printing position, wherein the medium casing includes an opening area, which exposes at least one side of a part of the printing medium to the exterior, on an inner wall side thereof, wherein the printing apparatus further comprises a brush which is disposed at a first brush standby position outside the medium casing and brushes off at least the side of the outermost printing medium of the at least one printing medium conveyed to the second medium standby position through the opening area, wherein the medium casing includes four inner wall sides along four sides of accommodated printing medium, wherein the opening area is provided in at least two inner wall sides of the four inner wall sides, and wherein the printing apparatus further comprises at least two brushes which brush off, through two or more opening areas, respective sides of at least the outermost located printing medium in the stacking direction of the at least one printing medium conveyed to the second medium standby position.

2. The printing apparatus according to claim 1, wherein the brush includes:

a plurality of brush hairs which brush off the side of the printing medium through the opening area; and a brush main body on which the plurality of brush hairs are fixed, and wherein the printing apparatus further includes a brush-turning unit which turns the brush main body such that the side of the printing medium is brushed off the brush hairs along the direction parallel to the inner wall side.

3. The printing apparatus according to claim 1, wherein the printing medium conveying unit includes:

a conveying belt on which the fed printing medium from the feeding unit is placed; and a turning roller which turns the conveying belt, and wherein the medium casing is installed such that the printing medium are inclined, with respect to the conveying plane, to any position from a state where the printing medium in the medium casing are substantially parallel to the conveying plane to a state where the angle between the printing surface of the outermost located printing medium in the stacking direction and the conveying plane is substantially 90 degrees.

4. The printing apparatus according to claim 3, further comprising a beam which crosses the opening area nonparallel to the direction along which the brush is moved by the brush-moving unit.

5. The printing apparatus according to claim 4,
wherein the beam is installed only by one on the diagonal line of the inner wall side.

6. The printing apparatus according to claim 1, further comprising;
a brush-moving unit which moves the brush between the first brush standby position corresponding to the second medium standby position and the second brush standby position corresponding to the first medium standby position, which is isolated from the corresponding first brush standby position; and
a brush controlling unit which brushes off one side of respective printing medium in the medium casing at least one time by the brush hairs while causing the brush-moving unit to move the brush.

7. The printing apparatus according to claim 6,
wherein projection areas in which the opening area is projected in the stacking direction of the printing medium are integrated with respect to a virtual plane parallel to the printing medium in the medium casing.

8. The printing apparatus according to claim 1,
wherein the feeding unit further includes a feeding port through which the fed printing medium from the medium casing passes, and
wherein the printing apparatus further comprises an outer casing which surrounds and accommodates the medium casing and the brush.

9. The printing apparatus according to claim 8,
wherein the brush is disposed in the vicinity of the feeding port.

10. The printing apparatus according to claim 8, further comprising:
an air flow generating unit; and
a filter which filters air,
wherein the outer casing includes:
an inflow port formed therein, which causes the atmospheric air filtrated by the filter to flow inwardly, resulting from air flows generated by the air flow generating unit; and
an outflow port formed therein, which causes the inside air to flow outwardly, resulting from the air flows generated by the air flow generating unit.

11. The printing apparatus according to claim 10,
herein the outer casing includes:
a first inner wall side opposed to the printing surface of a printing medium accommodated in the medium casing; and
a second inner wall side opposed to the opposite side of the printing surface of the corresponding printing medium,
wherein the inflow port is formed at the first inner wall side, and wherein the outflow port is formed at the second inner wall side.

12. The printing apparatus according to claim 11,
wherein the outer casing further includes a third inner wall side which is formed between the first inner wall side and the second inner wall side and links the first inner wall side and the second inner wall side with each other, and
wherein the inflow port and the outflow port are formed in an area close to the third inner wall side of the first and the second inner wall sides.

13. The printing apparatus according to claim 12,
wherein the outflow port is further formed in the third inner wall side.

14. The printing apparatus according to claim 13,
wherein the outflow port is opposed to the feeding port.

15. The printing apparatus according to claim 1,
wherein the feeding unit further includes a feeding port through which the fed printing medium from the medium casing passes, and
wherein the printing apparatus further comprises an outer casing which surrounds and accommodates the medium casing and the brush.

16. The printing apparatus according to claim 15,
wherein the brush is disposed in the vicinity of the feeding port.

17. The printing apparatus according to claim 15, further comprising:
an air flow generating unit; and
a filter which filters air,
wherein the outer casing includes:
an inflow port formed therein, which causes the atmospheric air filtrated by the filter to flow inwardly, resulting from air flows generated by the air flow generating unit; and
an outflow port formed therein, which causes the inside air to flow outwardly, resulting from the air flows generated by the air flow generating unit.

18. The printing apparatus according to claim 17,
wherein the outer casing includes:
a first inner wall side opposed to the printing surface of a printing medium accommodated in the medium casing; and
a second inner wall side opposed to the opposite side of the printing surface of the corresponding printing medium,
wherein the inflow port is formed at the first inner wall side, and
wherein the outflow port is formed at the second inner wall side.

19. The printing apparatus according to claim 18,
wherein the outer casing further includes a third inner wall side which is formed between the first inner wall side and the second inner wall side and links the first inner wall side and the second inner wall side with each other, and
wherein the inflow port and the outflow port are formed in an area close to the third inner wall side of the first and the second inner wall sides.

20. The printing apparatus according to claim 19,
wherein the outflow port is further formed in the third inner wall side.

21. The printing apparatus according to claim 20,
wherein the outflow port is opposed to the feeding port.

22. The printing apparatus according to claim 1,
wherein the feeding unit further includes a feeding port through which the fed printing medium from the medium casing passes, and
wherein the printing apparatus further comprises an outer casing which surrounds and accommodates the medium casing and the brush.

23. The printing apparatus according to claim 22,
wherein the brush is disposed in the vicinity of the feeding port.

24. The printing apparatus according to claim 23, further comprising:
an air flow generating unit; and
a filter which filters air,
wherein the outer casing includes:

an inflow port formed therein, which causes the atmospheric air filtrated by the filter to flow inwardly, resulting from air flows generated by the air flow generating unit; and an outflow port formed therein, which causes the inside air to flow outwardly, resulting from the air flows generated by the air flow generating unit.

25. The printing apparatus according to claim 24, wherein the outer casing includes:

a first inner wall side opposed to the printing surface of a printing medium accommodated in the medium casing; and a second inner wall side opposed to the opposite side of the printing surface of the corresponding printing medium, wherein the inflow port is formed at the first inner wall side, and wherein the outflow port is formed at the second inner wall side.

26. The printing apparatus according to claim 25, wherein the outer casing further includes a third inner wall side which is formed between the first inner wall side and the second inner wall side and links the first inner wall side and the second inner wall side with each other, and wherein the inflow port and the outflow port are formed in an area close to the third inner wall side of the first and the second inner wall sides.

27. The printing apparatus according to claim 26, wherein the outflow port is further formed in the third inner wall side.

28. The printing apparatus according to claim 27, wherein the outflow port is opposed to the feeding port.

29. A printing apparatus comprising;

a medium casing which accommodates at least one printing medium in a stack manner;

an accommodated medium conveying unit which conveys the at least one printing medium accommodated in the medium casing from a first medium standby position to a second medium standby position;

a feeding unit which feeds an outermost printing medium of the at least one printing medium conveyed to the second medium standby position from the medium casing;

a printing medium conveying unit which conveys the fed printing medium from the feeding unit to a printing position;

a print head which is disposed at a position opposed to the printing position and carries out a printing process on a printing surface of the conveyed printing medium; and a brush which brushes off the printing surface of the printing medium at a position between the second medium standby position and the printing position, wherein the medium casing includes an opening area, which exposes at least one side of a part of the printing medium to the exterior, on an inner wall side thereof, wherein the printing apparatus further comprises a brush which is disposed at a first brush standby position outside the medium casing and brushes off at least the side of the outermost printing medium of the at least one printing medium conveyed to the second medium standby position through the opening area, wherein the brush includes:

a plurality of brush hairs which brush off the side of the printing medium through the opening area; and a brush main body on which the plurality of brush hairs are fixed, and wherein the printing apparatus further includes a brush-turning unit which turns the brush main body such that the side of the printing medium is brushed off the brush hairs along the direction parallel to the inner wall side, wherein the brush main body includes at least one suction port, and wherein the printing apparatus further includes:

a suction unit which sucks air through the suction port; and a suction controlling unit which controls the suction unit to suck in air through the suction port when the brush hairs brush off the side of the printing medium.

30. The printing apparatus according to claim 29, wherein the suction controlling unit controls the suction unit to suck in air through the suction port when the brush hairs brush off the side of the printing medium.

31. A printing apparatus comprising;

a medium casing which accommodates at least one printing medium in a stack manner;

an accommodated medium conveying unit which conveys the at least one printing medium accommodated in the medium casing from a first medium standby position to a second medium standby position;

a feeding unit which feeds an outermost printing medium of the at least one printing medium conveyed to the second medium standby position from the medium casing;

a printing medium conveying unit which conveys the fed printing medium from the feeding unit to a printing position;

a print head which is disposed at a position opposed to the printing position and carries out a printing process on a printing surface of the conveyed printing medium;

a brush which brushes off the printing surface of the printing medium at a position between the second medium standby position and the printing position;

an air flow generating unit;

a first filter which filtrates air;

a first inflow port, formed in the outer casing, through which outside air filtrated by the first filter is caused to flow in based on air flows generated by the air flow generating unit; and an outflow port through which the inside air is caused to flow out based on air flows generated by the air flow generating unit, wherein the medium casing includes an opening area, which exposes at least one side of a part of the printing medium to the exterior, on an inner wall side thereof, wherein the printing apparatus further comprises a brush which is disposed at a first brush standby position outside the medium casing and brushes off at least the side of the outermost printing medium of the at least one printing medium conveyed to the second medium standby position through the opening area, wherein the outer casing includes wall plates having the outflow port formed in the outer wall side thereof, and wherein the wall plates include:

a cavity formed in the interior of the wall plate and communicating with the outflow port; and a second inflow port through which air between the outer casing and the inner casing is flowed into the cavity.

32. The printing apparatus according to claim 31, wherein the outer casing includes:

a first inner wall side and a second inner wall side respectively opposed to one surface and the other surface of printing medium accommodated in the inner casing; and wherein the first inflow port and the outflow port are respectively formed on the first inner wall side and the second inner wall side.

33. The printing apparatus according to claim 32, wherein at least one of the inflow port and the outflow port is opposed to one surface or the other surface of the printing medium accommodated in the inner casing.

34. The printing apparatus according to claim 32, wherein the outer casing further includes a third inner wall side which is formed between the first inner wall side and the second inner wall side and crosses both the first inner wall side and the second inner wall side, and wherein the outflow port is formed in the third inner wall side.

35. The printing apparatus according to claim 34, wherein the inner casing further includes a fourth inner wall side along one side of the printing medium accommodated in the inner casing, and wherein the outflow port is opposed to the fourth inner wall side.

36. The printing apparatus according to claim 31, wherein the air flow generating unit includes a positive pressure applying unit which applies positive pressure to air at the exterior of the outer casing such that the air is oriented and flown into the first inflow port.

37. The printing apparatus according to claim 31, wherein the inner wall side of the wall plate includes a plane area opposed to the opening area formed in the inner casing, and wherein the second inflow port is formed in the plane area.

38. The printing apparatus according to claim 31, wherein the second inflow port is opposed to the opening area.

39. The printing apparatus according to claim 31, wherein the air flow generating unit includes a negative pressure applying unit which applies negative pressure to the air at the exterior of the outer casing such that air is discharged from the outflow port.

40. The printing apparatus according to claim 31, further comprising a second filter which filtrates air passing through the outflow port, the second filter having a mesh coarser than that of the first filter.

* * * * *